US009064651B2

(12) United States Patent
Hsu et al.

(10) Patent No.: US 9,064,651 B2
(45) Date of Patent: Jun. 23, 2015

(54) KEYSWITCH

(75) Inventors: Chien-Shih Hsu, Taoyuan (TW); Ji-Huang Chen, Taoyuan (TW); Zuei-Chown Jou, Taoyuan (TW); Chi-Cheng Lin, Taoyuan (TW)

(73) Assignees: DARFON ELECTRONICS CORP., Taoyuan (TW); BanQ Corporation, Taipei (TW)

( * ) Notice: Subject to any disclaimer, the term of this patent is extended or adjusted under 35 U.S.C. 154(b) by 171 days.

(21) Appl. No.: 13/541,655

(22) Filed: Jul. 3, 2012

(65) Prior Publication Data

US 2013/0126323 A1 May 23, 2013

(30) Foreign Application Priority Data

Nov. 17, 2011 (TW) ..... 100142162 A

(51) Int. Cl.

| | |
|---|---|
| ***H01H 9/00*** | (2006.01) |
| ***H01H 13/02*** | (2006.01) |
| ***H01H 13/7065*** | (2006.01) |
| *H01H 13/22* | (2006.01) |
| *H01H 3/12* | (2006.01) |
| *H01H 13/06* | (2006.01) |
| *H01H 13/702* | (2006.01) |

(52) U.S. Cl.

CPC ..... *H01H 13/02* (2013.01); *H01H 13/22* (2013.01); *H01H 3/12* (2013.01); *H01H 13/06* (2013.01); *H01H 13/702* (2013.01); *H01H 13/7065* (2013.01); *H01H 2221/04* (2013.01); *H01H 2221/09* (2013.01)

(58) Field of Classification Search

CPC ..... H01H 2221/04; H01H 9/443; H01H 2036/0086; H01H 3/46; H01H 3/125

USPC ..... 335/205

See application file for complete search history.

(56) References Cited

U.S. PATENT DOCUMENTS

| | | | | |
|---|---|---|---|---|
| 3,644,856 A | | 2/1972 | Scott | |
| 4,296,394 A | | 10/1981 | Ragheb | |
| 4,453,148 A | | 6/1984 | Norakidze | |
| 4,689,608 A | | 8/1987 | Bolda | |
| 5,268,545 A | * | 12/1993 | Bruner | 200/345 |
| 5,769,210 A | * | 6/1998 | Tsai | 200/344 |
| 5,813,521 A | * | 9/1998 | Koike et al. | 200/344 |

(Continued)

FOREIGN PATENT DOCUMENTS

| | | |
|---|---|---|
| CN | 101409166 A | 4/2009 |
| CN | 201741607 U | 2/2011 |

(Continued)

*Primary Examiner* — Shawki S Ismail
*Assistant Examiner* — Lisa Homza

(57) ABSTRACT

A keyswitch includes a casing, a key cap and a support device rotatably disposed between the key cap and the casing. One of the casing and the key cap has a first magnetic area and the support device has a second magnetic area corresponding to the first magnetic area. When the key cap is not pressed, a magnetic attraction force between the first and second magnetic areas keeps the key cap at a non-pressed position. When the key cap is pressed by an external force such that the second magnetic area moves away from the first magnetic area, the key cap moves from the non-pressed position toward the pressed position. When the external force is removed, the second magnetic area moves toward the first magnetic area due to the magnetic attraction force such that the key cap moves from the pressed position toward the non-pressed position.

27 Claims, 21 Drawing Sheets

(56) References Cited

U.S. PATENT DOCUMENTS

| | | | | |
|---|---|---|---|---|
| 6,060,676 | A * | 5/2000 | Pan | 200/344 |
| 6,118,092 | A * | 9/2000 | Hayashi | 200/344 |
| 6,392,515 | B1 * | 5/2002 | Van Zeeland et al. | 335/205 |
| 6,531,667 | B2 * | 3/2003 | Becker et al. | 200/86.5 |
| 6,556,112 | B1 * | 4/2003 | Van Zeeland et al. | 335/205 |
| 6,635,838 | B1 * | 10/2003 | Kornelson | 200/341 |
| 6,670,873 | B2 | 12/2003 | Inada | |
| 6,677,843 | B1 * | 1/2004 | Monroe et al. | 335/205 |
| 6,706,985 | B2 * | 3/2004 | Chun | 200/344 |
| 6,723,935 | B1 * | 4/2004 | Watanabe | 200/344 |
| 6,759,933 | B2 * | 7/2004 | Fallak | 335/207 |
| 6,761,494 | B2 | 7/2004 | Hsu | |
| 6,812,421 | B2 * | 11/2004 | Sato et al. | 200/344 |
| 6,936,782 | B2 * | 8/2005 | Ito | 200/344 |
| 6,972,385 | B2 * | 12/2005 | Krebs et al. | 200/1 B |
| 7,022,929 | B1 * | 4/2006 | Snider | 200/512 |
| 7,312,414 | B2 * | 12/2007 | Yatsu et al. | 200/344 |
| 7,319,202 | B2 * | 1/2008 | Sato | 200/344 |
| 7,449,651 | B2 * | 11/2008 | Lin | 200/344 |
| 7,595,712 | B2 * | 9/2009 | Nishino et al. | 335/207 |
| 7,642,886 | B2 * | 1/2010 | Boss | 335/205 |
| 7,728,242 | B2 * | 6/2010 | Huang | 200/341 |
| 7,954,222 | B2 * | 6/2011 | Hsu et al. | 29/436 |
| 8,629,362 | B1 * | 1/2014 | Knighton et al. | 200/344 |
| 2003/0224737 | A1 * | 12/2003 | Yokoji et al. | 455/90.3 |
| 2005/0123333 | A1 * | 6/2005 | Sugimura et al. | 400/485 |
| 2006/0257190 | A1 * | 11/2006 | Chiang | 400/474 |
| 2006/0267962 | A1 * | 11/2006 | Baier | 345/173 |
| 2007/0181410 | A1 * | 8/2007 | Baier | 200/17 R |
| 2008/0237012 | A1 * | 10/2008 | Koike et al. | 200/314 |
| 2012/0169603 | A1 | 7/2012 | Peterson | |
| 2012/0313738 | A1 * | 12/2012 | Chang et al. | 335/205 |
| 2013/0233685 | A1 * | 9/2013 | Zhang | 200/344 |

FOREIGN PATENT DOCUMENTS

| | | | |
|---|---|---|---|
| CN | 103065842 | A | 4/2013 |
| EP | 0 189 132 | A2 | 7/1986 |
| EP | 0 189 132 | A3 | 7/1986 |
| JP | 2006260866 | A | 9/2006 |
| WO | 2007114631 | A2 | 10/2007 |
| WO | 2007114631 | A3 | 10/2007 |

* cited by examiner

KEYSWITCH

BACKGROUND OF THE INVENTION

1. Field of the Invention

The invention relates to a keyswitch and, more particularly, to a keyswitch utilizing a magnetic attraction force to drive a key cap to move with a support device between a non-pressed position and a pressed position.

2. Description of the Prior Art

A keyboard, which is the most common input device, can be found in variety of electronic equipments for users to input characters, symbols, numerals and so on. From consumer electronic products to industrial machine tools are all equipped with a keyboard for purpose of operation.

Referring to FIG. 1, FIG. 1 is a cross-sectional view illustrating a keyswitch 1 of the prior art. As shown in FIG. 1, the keyswitch 1 comprises a base 10, a key cap 12, a circuit board 14, a support device 16 and a resilient member 18. The circuit board 14 is disposed on the base 10. The support device 16 is disposed between the key cap 12 and the base 10 and used for supporting the key cap 12. The resilient member 18 is also disposed between the key cap 12 and the base 10. After the key cap 12 is pressed by a user, the resilient member 18 provides an elastic force for the key cap 12 so as to make the key cap 12 returns to the original position. The resilient member 18 is usually made of rubber and rubber may get fatigue after being used for a long time such that the lifetime of the keyswitch 1 may be reduced.

SUMMARY OF THE INVENTION

Therefore, an objective of the invention is to provide a keyswitch utilizing a magnetic attraction force to drive a key cap to move with a support device between a non-pressed position and a pressed position.

According to an embodiment of the invention, a keyswitch comprises a casing, a key cap and a support device. The support device is disposed between the casing and the key cap and rotatably connected to the key cap and the casing. The key cap moves with the support device between a non-pressed position and a pressed position. One of the casing and the key cap has a first magnetic area and the support device has a second magnetic area corresponding to the first magnetic area. When the key cap is not pressed, a magnetic attraction force between the first magnetic area and the second magnetic area keeps the key cap at the non-pressed position. When the key cap is pressed by an external force such that the second magnetic area moves away from the first magnetic area, the key cap moves with the support device from the non-pressed position toward the pressed position. When the external force is removed, the second magnetic area moves toward the first magnetic area due to the magnetic attraction force such that the key cap moves with the support device from the pressed position toward the non-pressed position.

According to another embodiment of the invention, a keyswitch comprises a base, a key cap and a support device. The support device is disposed between the base and the key cap and rotatably connected to the key cap and the base. The key cap moves with the support device between a non-pressed position and a pressed position. The key cap has a first magnetic area and the support device has a second magnetic area corresponding to the first magnetic area. When the key cap is not pressed, a magnetic attraction force between the first magnetic area and the second magnetic area keeps the key cap at the non-pressed position. When the key cap is pressed by an external force such that the second magnetic area moves away from the first magnetic area, the key cap moves with the support device from the non-pressed position toward the pressed position. When the external force is removed, the second magnetic area moves toward the first magnetic area due to the magnetic attraction force such that the key cap moves with the support device from the pressed position toward the non-pressed position.

According to another embodiment of the invention, a keyswitch comprises a base, a key cap and a support device. The support device is disposed between the base and the key cap and rotatably connected to the key cap and the base. The key cap moves with the support device between a non-pressed position and a pressed position. The base has a first magnetic area and the support device has a second magnetic area corresponding to the first magnetic area. When the key cap is not pressed, a magnetic attraction force between the first magnetic area and the second magnetic area keeps the key cap at the non-pressed position. When the key cap is pressed by an external force such that the second magnetic area moves away from the first magnetic area, the key cap moves with the support device from the non-pressed position toward the pressed position. When the external force is removed, the second magnetic area moves toward the first magnetic area due to the magnetic attraction force such that the key cap moves with the support device from the pressed position toward the non-pressed position.

According to another embodiment of the invention, a keyswitch comprises a base, a frame, a key cap and a support device. The frame is disposed on the base. The key cap is disposed in the frame. The support device is disposed between the base and the key cap and rotatably connected to the key cap and the base. The key cap moves with the support device between a non-pressed position and a pressed position. The frame has a first magnetic area and the support device has a second magnetic area corresponding to the first magnetic area. When the key cap is not pressed, a magnetic attraction force between the first magnetic area and the second magnetic area keeps the key cap at the non-pressed position. When the key cap is pressed by an external force such that the second magnetic area moves away from the first magnetic area, the key cap moves with the support device from the non-pressed position toward the pressed position. When the external force is removed, the second magnetic area moves toward the first magnetic area due to the magnetic attraction force such that the key cap moves with the support device from the pressed position toward the non-pressed position.

As mentioned in the above, the first magnetic area of the invention is selectively disposed on one of the casing, which may be the base or a combination of the base and the frame, and the key cap, and the support device has the second magnetic area corresponding to the first magnetic area. When the key cap is not pressed, the magnetic attraction force between the first magnetic area and the second magnetic area keeps the key cap at the non-pressed position. When the key cap is pressed by the external force such that the second magnetic area moves away from the first magnetic area, the key cap moves with the support device from the non-pressed position toward the pressed position. When the external force is removed, the second magnetic area moves toward the first magnetic area due to the magnetic attraction force such that the key cap moves with the support device from the pressed position toward the non-pressed position. Since the resilient member of the conventional keyswitch is unnecessary for the invention, the lifetime of the keyswitch of the invention can be extended effectively.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
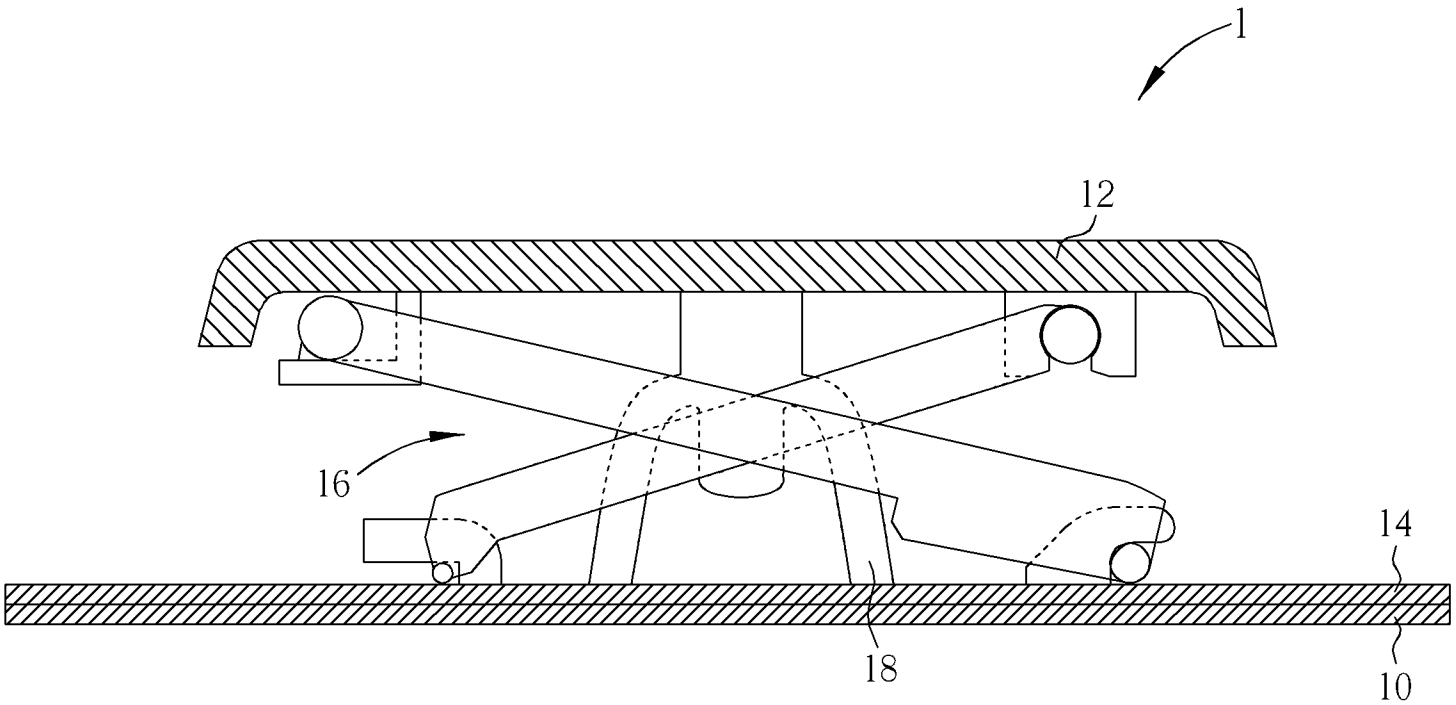
FIG. 1 PRIOR ART
FIG. 1 is a cross-sectional view illustrating a keyswitch of the prior art.
Figure 2:
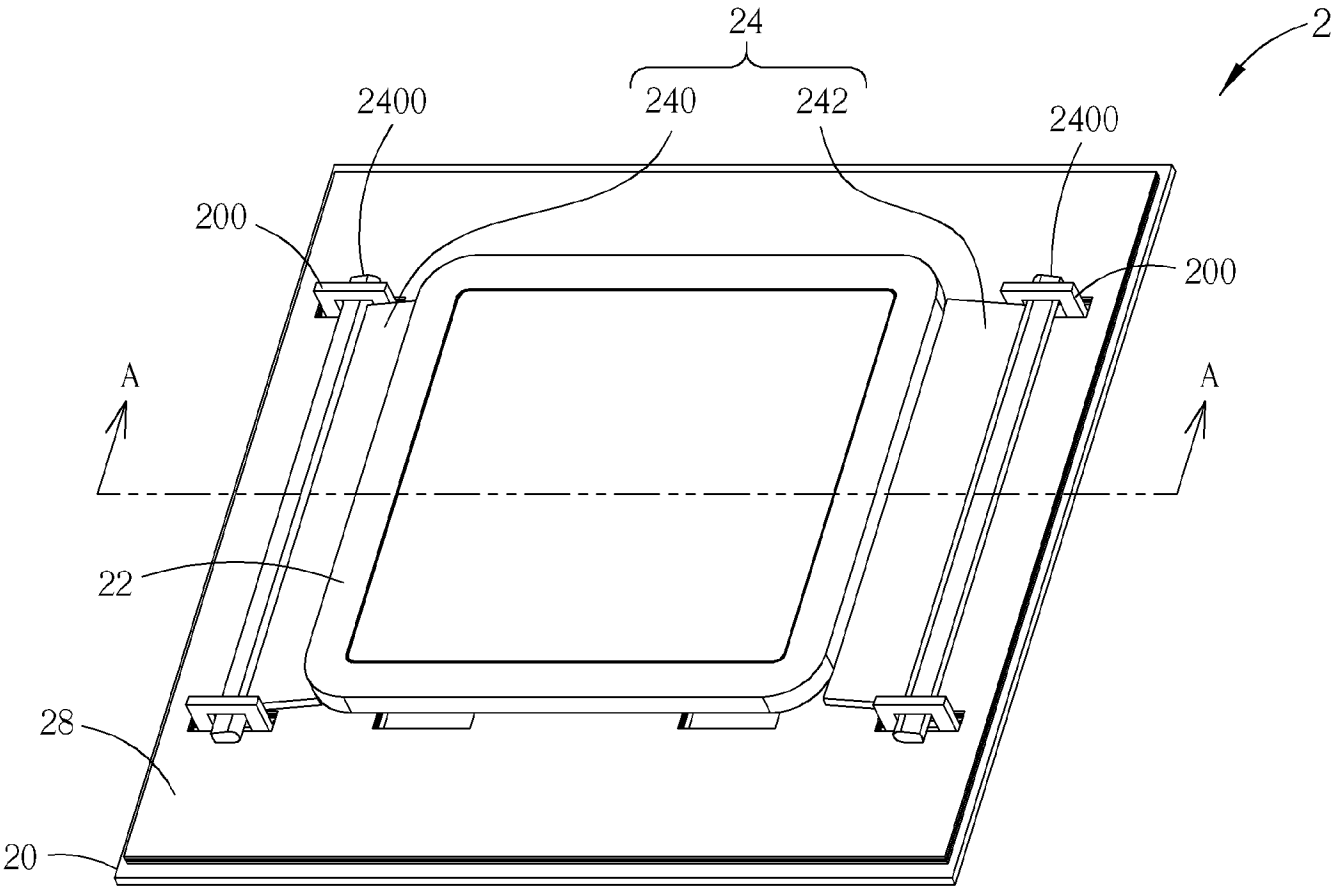
FIG. 2 is a perspective view illustrating a keyswitch according to an embodiment of the invention.
Figure 3:
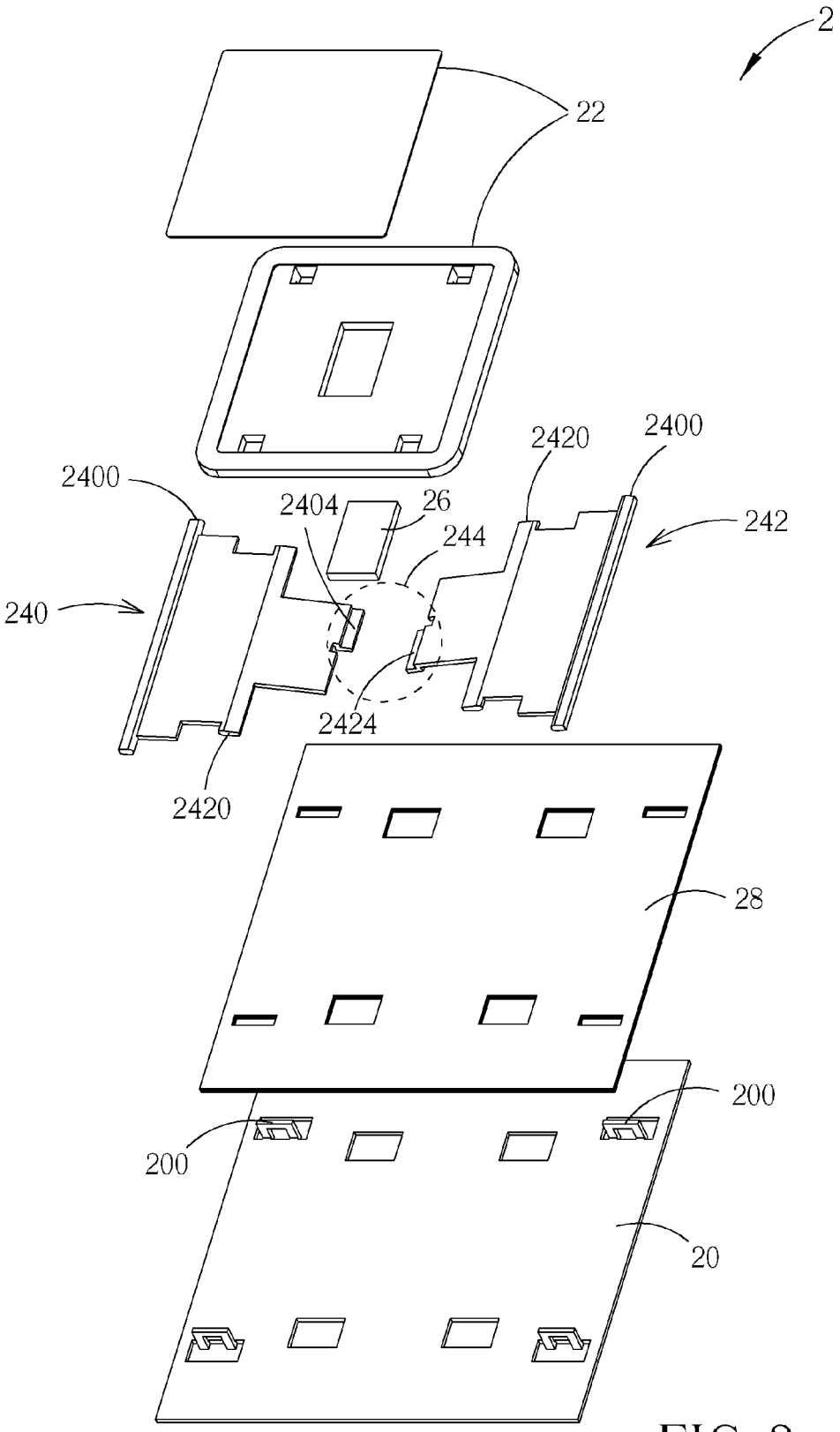
FIG. 3 is an exploded view illustrating the keyswitch shown in FIG. 2.
Figure 4:
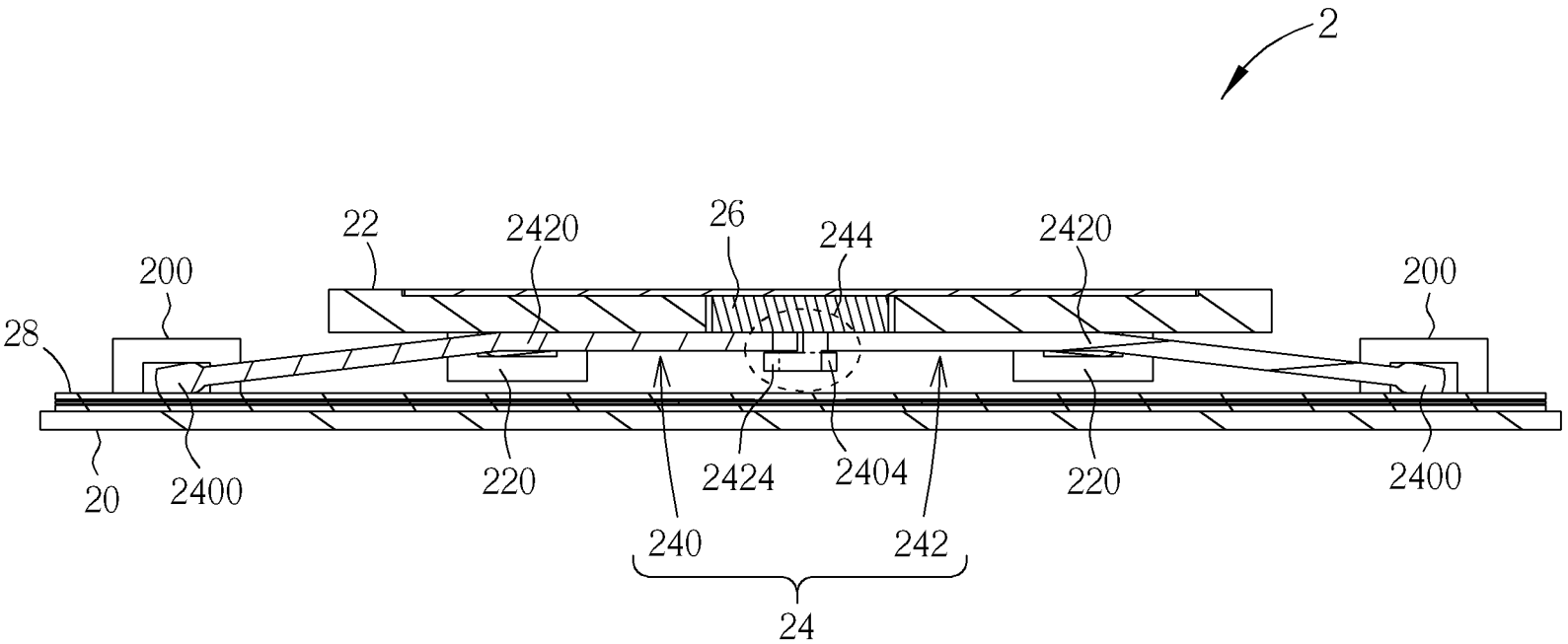
FIG. 4 is a cross-sectional view illustrating the keyswitch along line A-A shown in FIG. 2.
Figure 5:
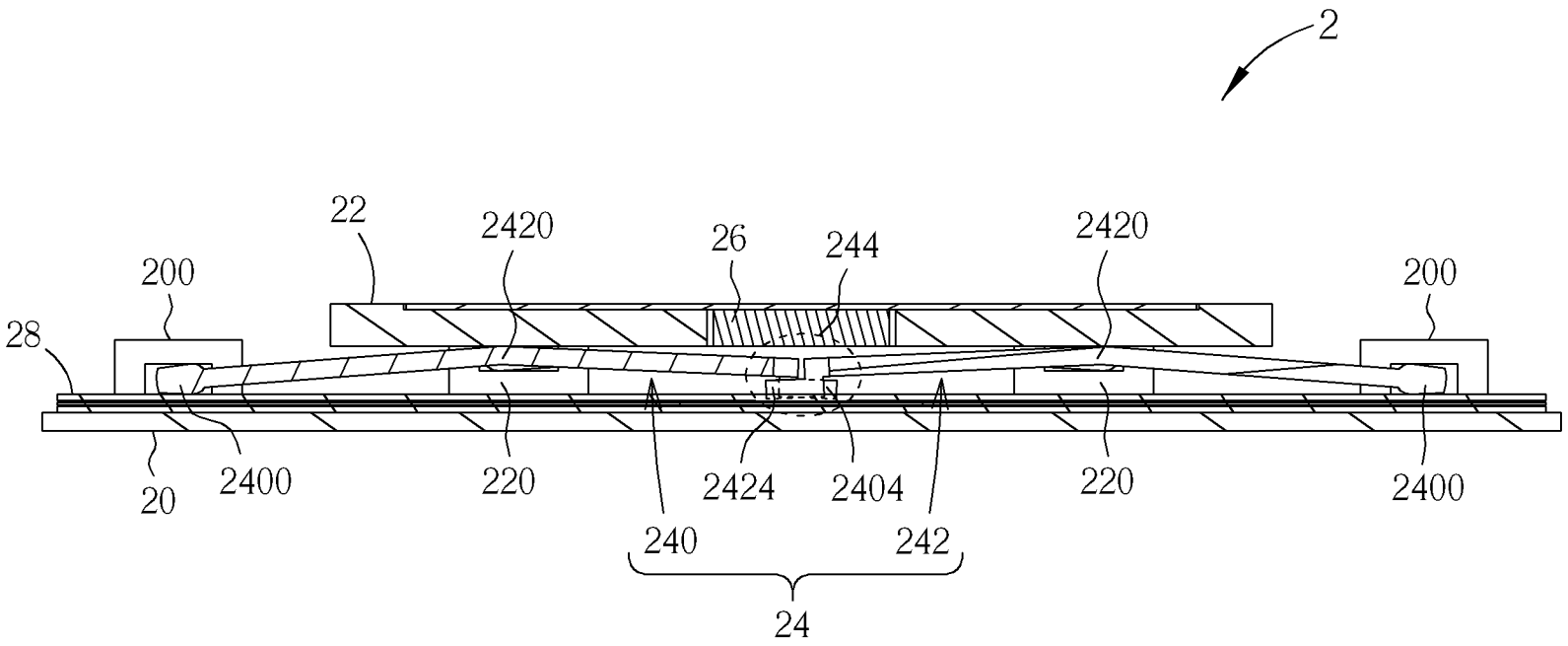
FIG. 5 is a cross-sectional view illustrating the key cap shown in FIG. 4 being pressed.

Referring to FIGS. 2 to 5, FIG. 2 is a perspective view illustrating a keyswitch 2 according to an embodiment of the invention, FIG. 3 is an exploded view illustrating the keyswitch 2 shown in FIG. 2, FIG. 4 is a cross-sectional view illustrating the keyswitch 2 along line A-A shown in FIG. 2, and FIG. 5 is a cross-sectional view illustrating the key cap 22 shown in FIG. 4 being pressed. As shown in FIGS. 2 to 5, the keyswitch 2 comprises a base 20, a key cap 22, a support device 24 and a circuit board 28. In this embodiment, the base 20 is a casing of the keyswitch 2. In practical applications, the circuit board 28 may be, but not limited to, a membrane circuit board.

The support device 24 is disposed between the base 20 and the key cap 22 and rotatably connected to the key cap 22 and the base 20. In this embodiment, the support device 24 may comprise a first support member 240 and a second support member 242. Each of the first support member 240 and the second support member 242 comprises a first connecting portion (i.e. a first end portion) 2400 and a second connecting portion (i.e. a central portion) 2420, wherein the first connecting portion 2400 is rotatably connected to the base 20 and the second connecting portion 2420 is rotatably connected to the key cap 22. In this embodiment, the first connecting portion 2400 is rotatably connected to a connecting socket 200 of the base 20 and the second connecting portion 2420 is rotatably connected to a connecting socket 220 of the key cap 22, but the invention is not limited to this embodiment. In other words, the first connecting portion 2400 is confined in the connecting socket 200 such that the first end portion is rotatably connected to the base 20. Accordingly, the key cap 22 can move with the support device 24 between a non-pressed position (as shown in FIG. 4) and a pressed position (as shown in FIG. 5). Furthermore, the first support member 240 has a first linking portion 2404 and the second support member 242 has a second linking portion 2424. The first linking portion 2404 abuts against the second member 242 and the second linking portion 2424 abuts against the first support member 240 such that the first support member 240 and the second support member 242 can rotate simultaneously when the key cap 22 is pressed or the external force is removed.

The key cap 22 has a first magnetic area 26 and the support device 24 has a second magnetic area (i.e. a second end portion) 244 corresponding to the first magnetic area 26. One of the first magnetic area 26 and the second magnetic area 244 may be a magnetic object (e.g. magnet) and the other one of the first magnetic area 26 and the second magnetic area 244 may be a magnetic object (e.g. magnet) or a magnetic induction material (e.g. iron or other metals). In this embodiment, the first magnetic area 26 may be a magnetic object and the second magnetic area 244 may be a magnetic induction material. In practical applications, the support device 24 may be made of magnetic induction material wholly. Furthermore, in another embodiment, the first magnetic area 26 and the second magnetic area 244 both may be magnets.

When the key cap 22 is not pressed, a magnetic attraction force between the first magnetic area 26 and the second magnetic area 244 keeps the key cap 22 at the non-pressed position (as shown in FIG. 4). When the key cap 22 is pressed by an external force, which can overcome the magnetic attraction force, such that the second magnetic area 244 moves away from the first magnetic area 26, the second magnetic area 244 pivots on the second connecting portion (i.e. the central portion) 2420 such that the key cap 22 moves with the support device 24 from the non-pressed position toward the pressed position (as shown in FIG. 5). When the external force is removed, the second magnetic area 244 moves toward the first magnetic area 26 due to the magnetic attraction force and the second magnetic area 244 drives the first support member 240 and the second support member 242 of the support device 24 to pivot on the second connecting portions (i.e. the central portion) 2420 such that the key cap 22 moves with the support device 24 from the pressed position toward the non-pressed position. As shown in FIG. 5, when the key cap 22 is pressed to the pressed position, the first linking portion 2404 of the first support member 240 and/or the second linking portion 2424 of the second support member 242 will trigger switch(es) of the circuit board 28 so as to execute input function correspondingly.

As shown in FIG. 4, the first support member 240 is formed as a V-shaped structure, wherein the first support member 240 has a first end portion 2400 and a second end portion 244 and an angle included between the first end portion 2400 and the second end portion 244 is larger than 90 degrees.

Figure 6:
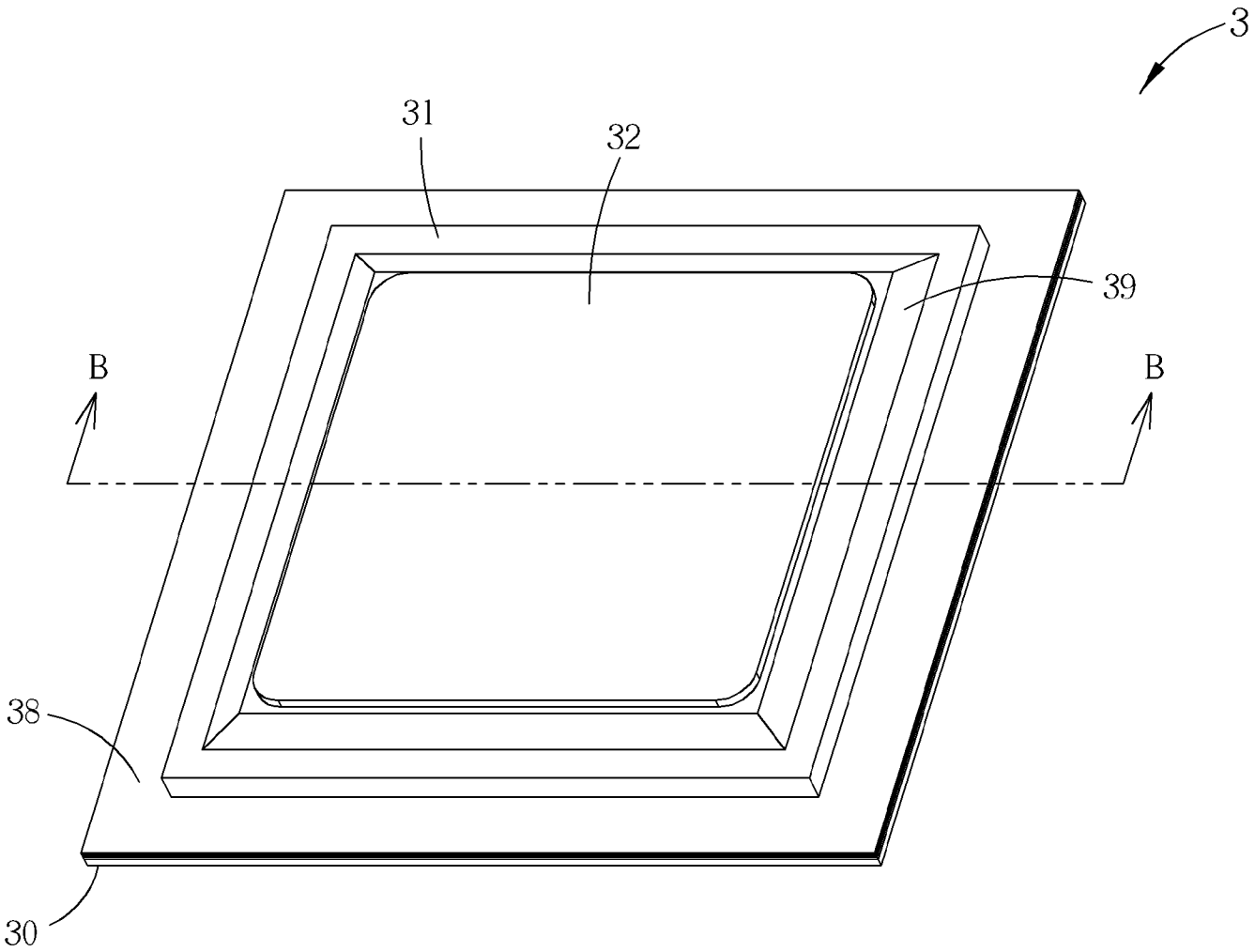
FIG. 6 is a perspective view illustrating a keyswitch according to another embodiment of the invention.
Figure 7:
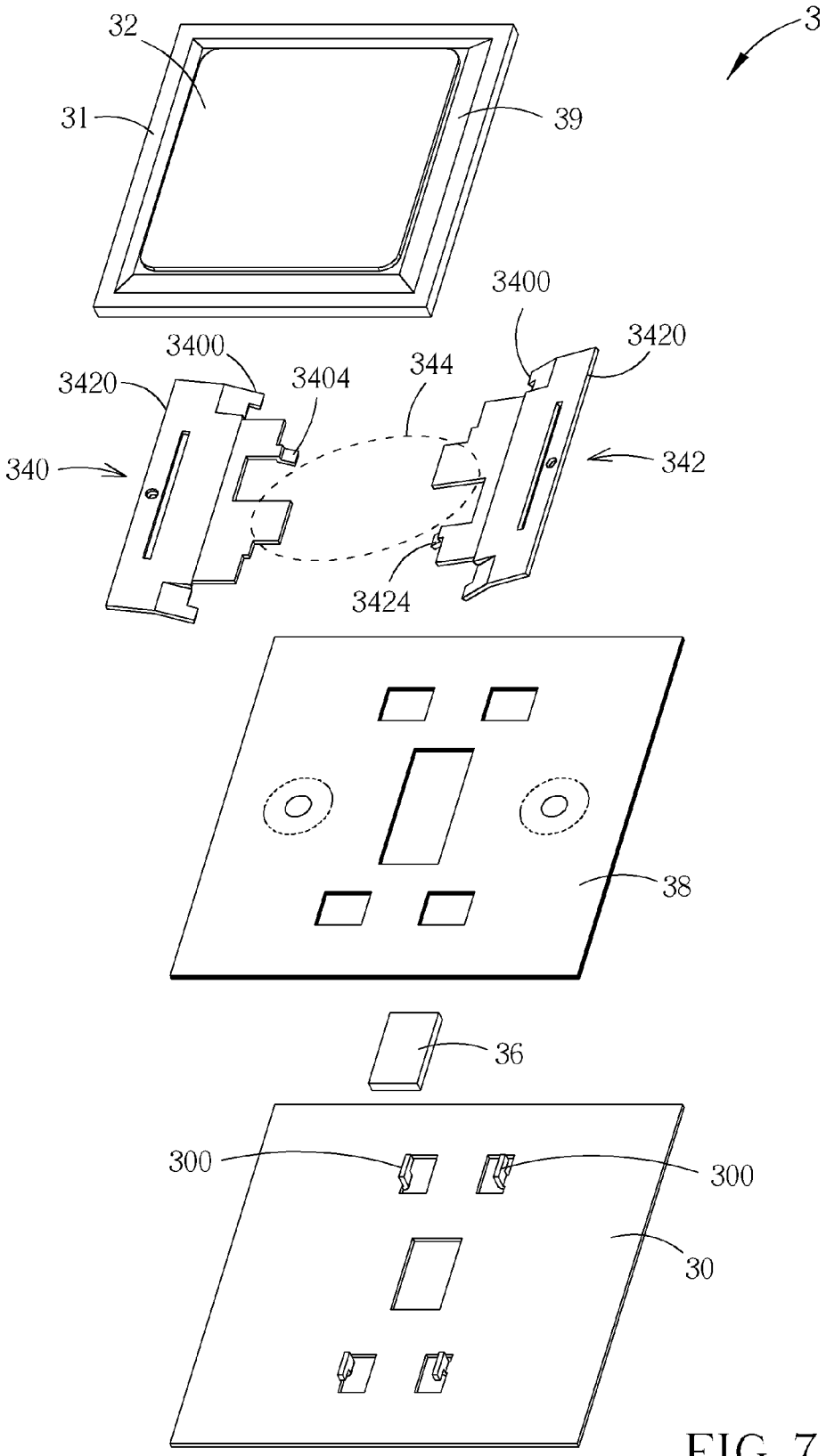
FIG. 7 is an exploded view illustrating the keyswitch shown in FIG. 6.
Figure 8:
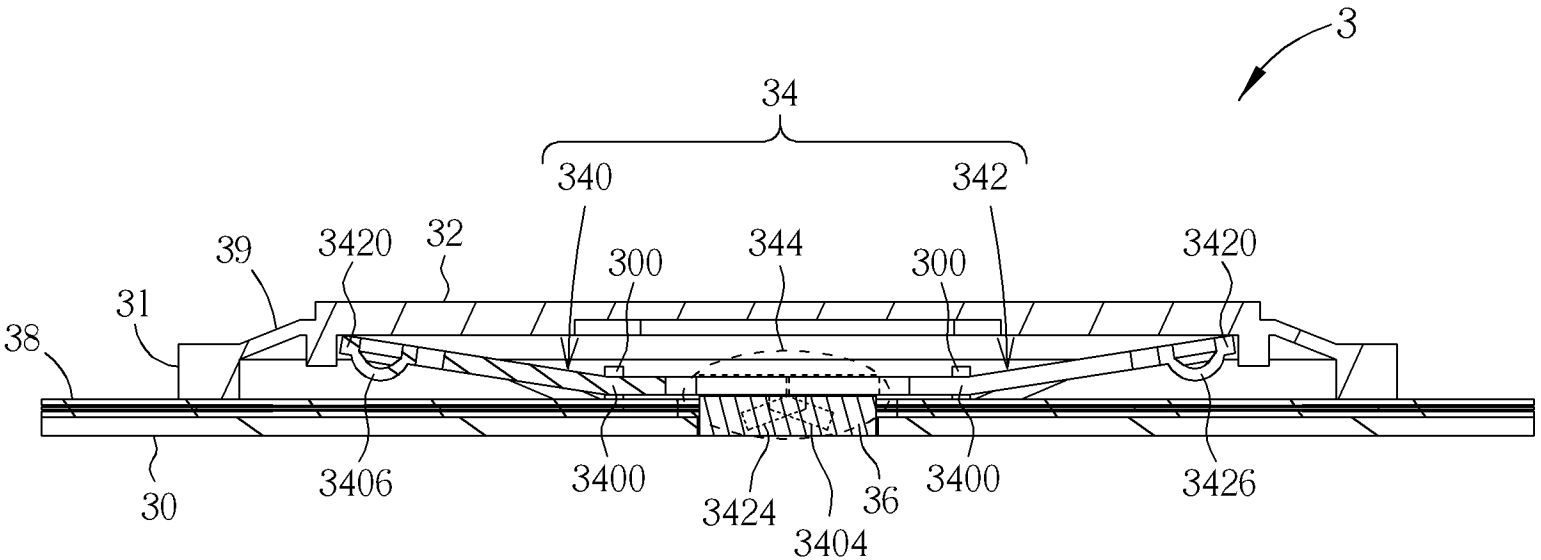
FIG. 8 is a cross-sectional view illustrating the keyswitch along line B-B shown in FIG. 6.
Figure 9:
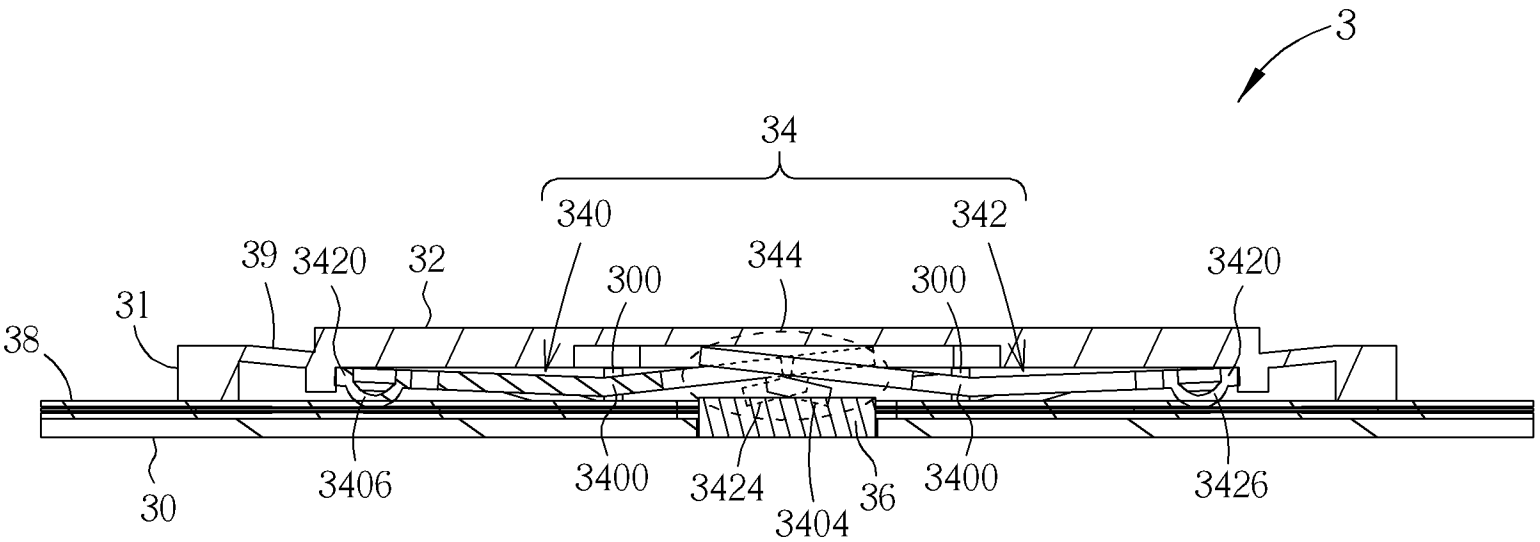
FIG. 9 is a cross-sectional view illustrating the key cap shown in FIG. 8 being pressed.

Referring to FIGS. 6 to 9, FIG. 6 is a perspective view illustrating a keyswitch 4 according to another embodiment of the invention, FIG. 7 is an exploded view illustrating the keyswitch 3 shown in FIG. 6, FIG. 8 is a cross-sectional view illustrating the keyswitch 3 along line B-B shown in FIG. 6, and FIG. 9 is a cross-sectional view illustrating the key cap 32 shown in FIG. 8 being pressed. As shown in FIGS. 6 to 9, the keyswitch 3 comprises a base 30, a frame 31, a key cap 32, a support device 34 and a circuit board 38. In this embodiment, the combination of the base 30 and the frame 31 is a casing of the keyswitch 3. In practical applications, the circuit board 38 may be, but not limited to, a membrane circuit board.

The frame 31 is disposed on the base 30 and the key cap 32 is disposed in the frame 31. In this embodiment, the key cap 32 may be connected to the frame 31 by a flexible material 39. The flexible material 39 surrounds the key cap 32 such that there is no gap between the key cap 32 and the frame 31. Accordingly, the flexible material 39 can prevent dust, beverage, water or other liquids from entering the space under the key cap 32. The support device 34 is disposed between the base 30 and the key cap 32 and rotatably connected to the key cap 32 and the base 30. In this embodiment, the support device 34 may comprise a first support member 340 and a second support member 342. Each of the first support member 340 and the second support member 342 comprises a first connecting portion (i.e. a central portion) 3400 and a second connecting portion (i.e. a first end portion) 3420, wherein the first connecting portion 3400 is rotatably connected to the base 30 and the second connecting portion 3420 is rotatably connected to the key cap 32. In this embodiment, the first connecting portion 3400 is rotatably connected to a connecting socket 300 of the base 30 and the second connecting portion 3420 abuts against the key cap 32 so as to be rotatably connected to the key cap 32, but the invention is not limited to this embodiment. In other words, the first connecting portion 3400 is confined in the connecting socket 300 such that the central portion is rotatably connected to the base 30. Accordingly, the key cap 32 can move with the support device 34 between a non-pressed position (as shown in FIG. 8) and a pressed position (as shown in FIG. 9). Furthermore, the first support member 340 has a first linking portion 3404 and the second support member 342 has a second linking portion 3424. The first linking portion 3404 abuts against the second member 342 and the second linking portion 3424 abuts against the first support member 340 such that the first support member 340 and the second support member 342 can rotate simultaneously when the key cap 32 is pressed or the external force is removed.

The base 30 has a first magnetic area 36 and the support device 34 has a second magnetic area (i.e. a second end portion) 344 corresponding to the first magnetic area 36. One of the first magnetic area 36 and the second magnetic area 344 may be a magnetic object (e.g. magnet) and the other one of the first magnetic area 36 and the second magnetic area 344 may be a magnetic object (e.g. magnet) or a magnetic induction material (e.g. iron or other metals). In this embodiment, the first magnetic area 36 may be a magnetic object and the second magnetic area 344 may be a magnetic induction material. In practical applications, the support device 34 may be made of magnetic induction material wholly. Furthermore, in another embodiment, the first magnetic area 36 and the second magnetic area 344 both may be magnets.

When the key cap 32 is not pressed, a magnetic attraction force between the first magnetic area 36 and the second magnetic area 344 keeps the key cap 32 at the non-pressed position (as shown in FIG. 8). When the key cap 32 is pressed by an external force, which can overcome the magnetic attraction force, such that the second magnetic area 344 moves away from the first magnetic area 36, the second magnetic area 344 pivots on the first connecting portion (i.e. the central portion) 3400 such that the key cap 32 moves with the support device 34 from the non-pressed position toward the pressed position (as shown in FIG. 9). When the external force is removed, the second magnetic area 344 moves toward the first magnetic area 36 due to the magnetic attraction force and the second magnetic area 344 drives the first support member 340 and the second support member 342 of the support device 34 to pivot on the first connecting portion (i.e. the central portion) 3400 such that the key cap 32 moves with the support device 34 from the pressed position toward the non-pressed position. As shown in FIG. 9, when the key cap 32 is pressed to the pressed position, a triggering portion 3406 of the first support member 340 and a triggering portion 3426 of the second support member 342 will trigger switches of the circuit board 38 so as to execute input function correspondingly.

As shown in FIG. 8, the first support member 340 is formed as a V-shaped structure, wherein the first support member 340 has a first end portion 3420 and a second end portion 344 and an angle included between the first end portion 3420 and the second end portion 344 is larger than 90 degrees.

Figure 10:
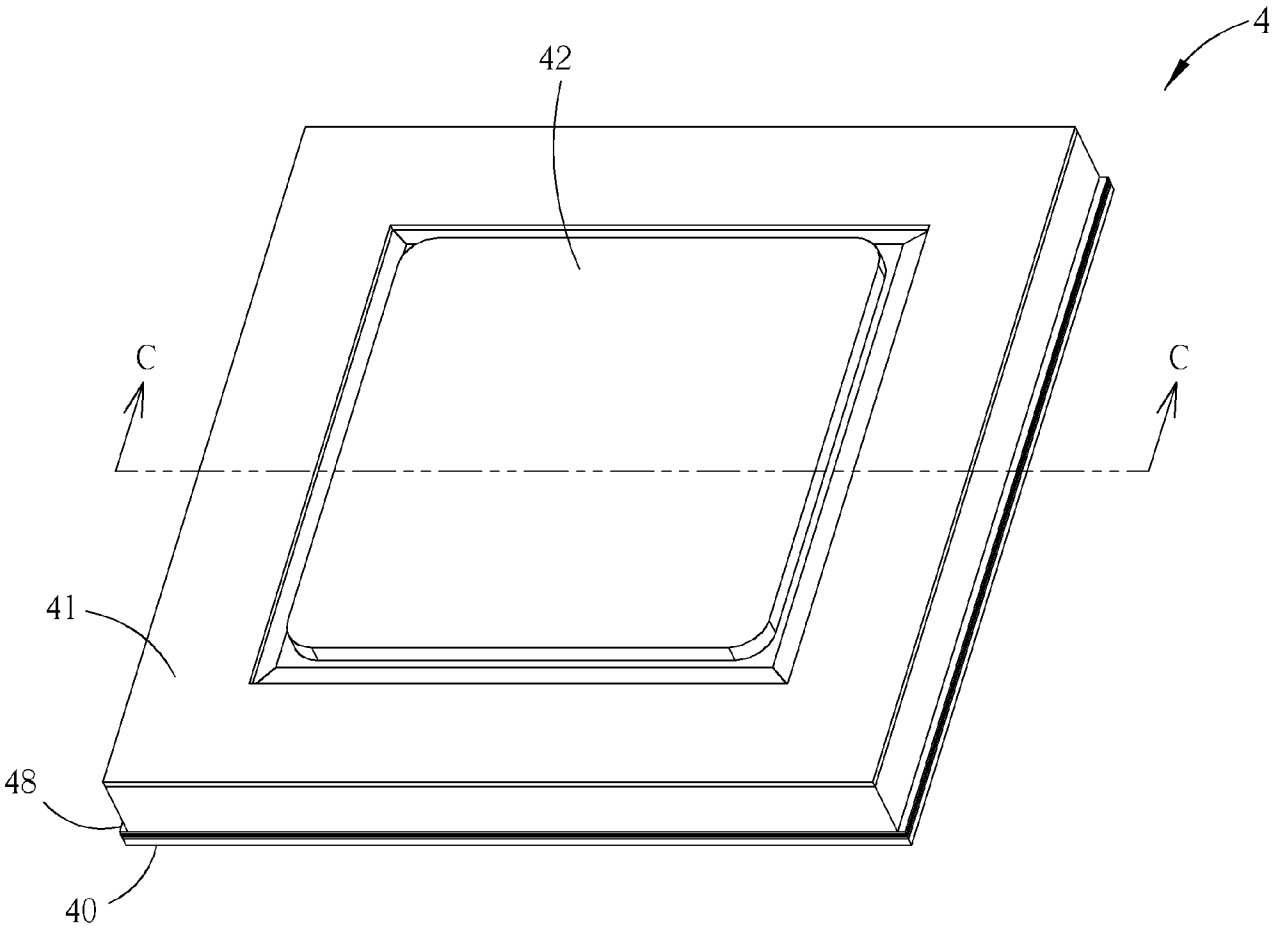
FIG. 10 is a perspective view illustrating a keyswitch according to another embodiment of the invention.
Figure 11:
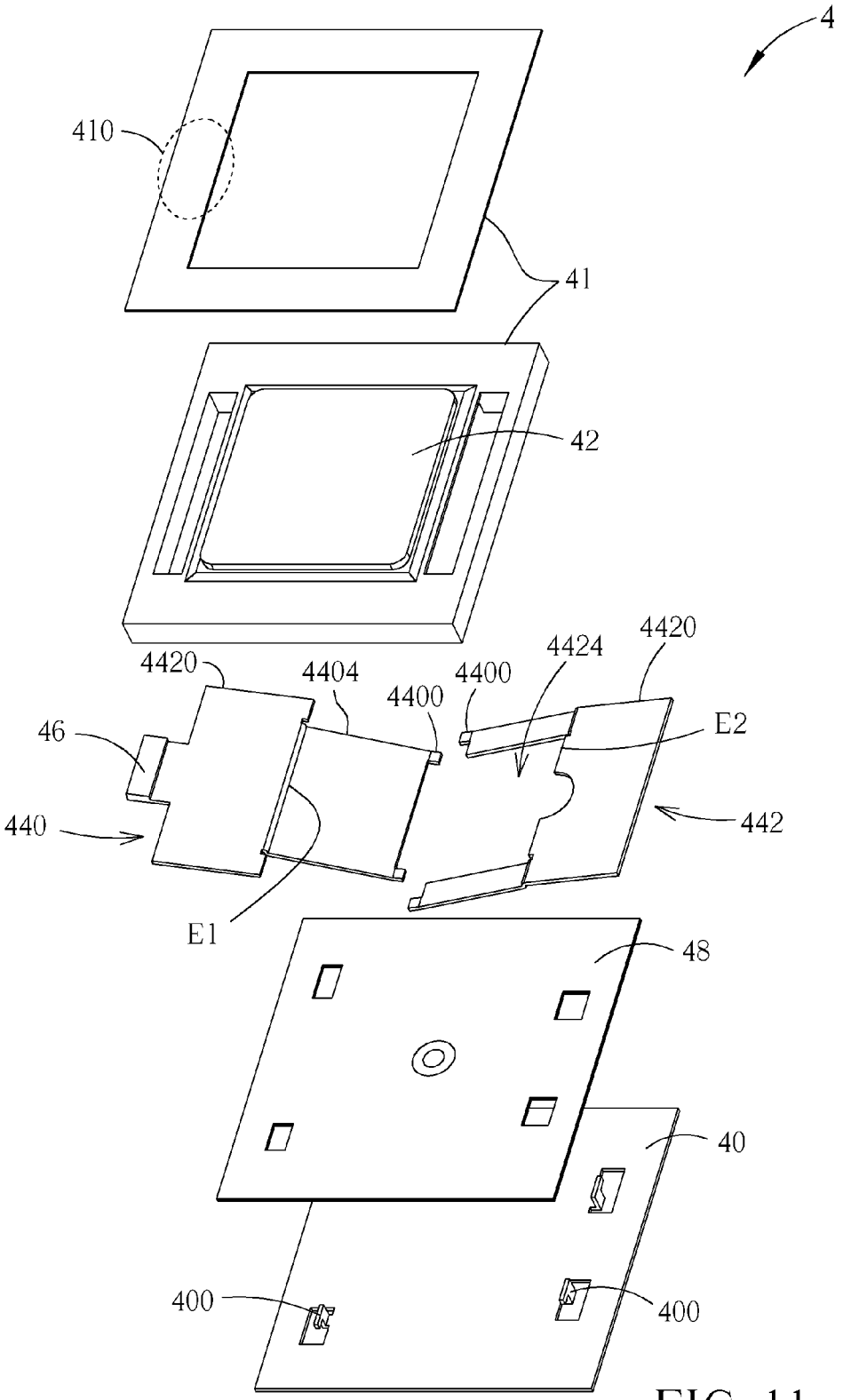
FIG. 11 is an exploded view illustrating the keyswitch shown in FIG. 10.
Figure 12:
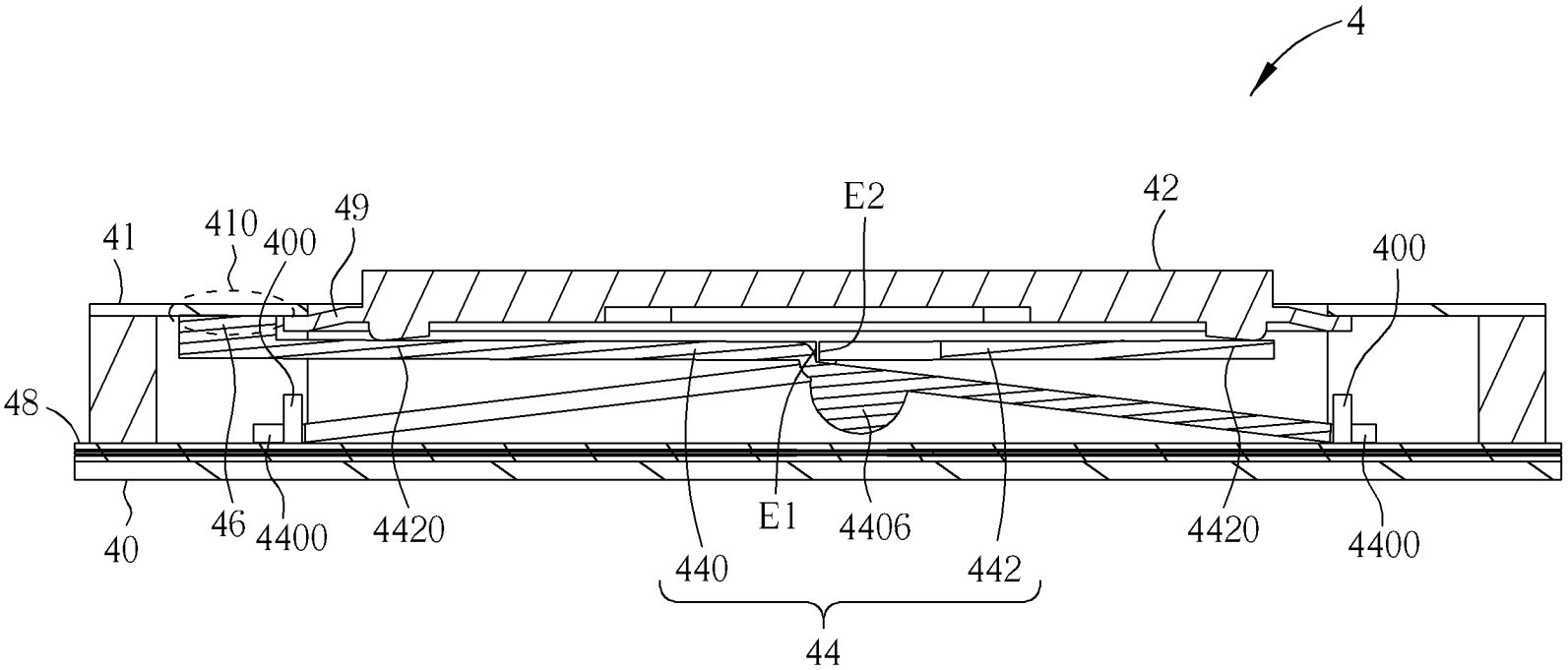
FIG. 12 is a cross-sectional view illustrating the keyswitch along line C-C shown in FIG. 12.
Figure 13:
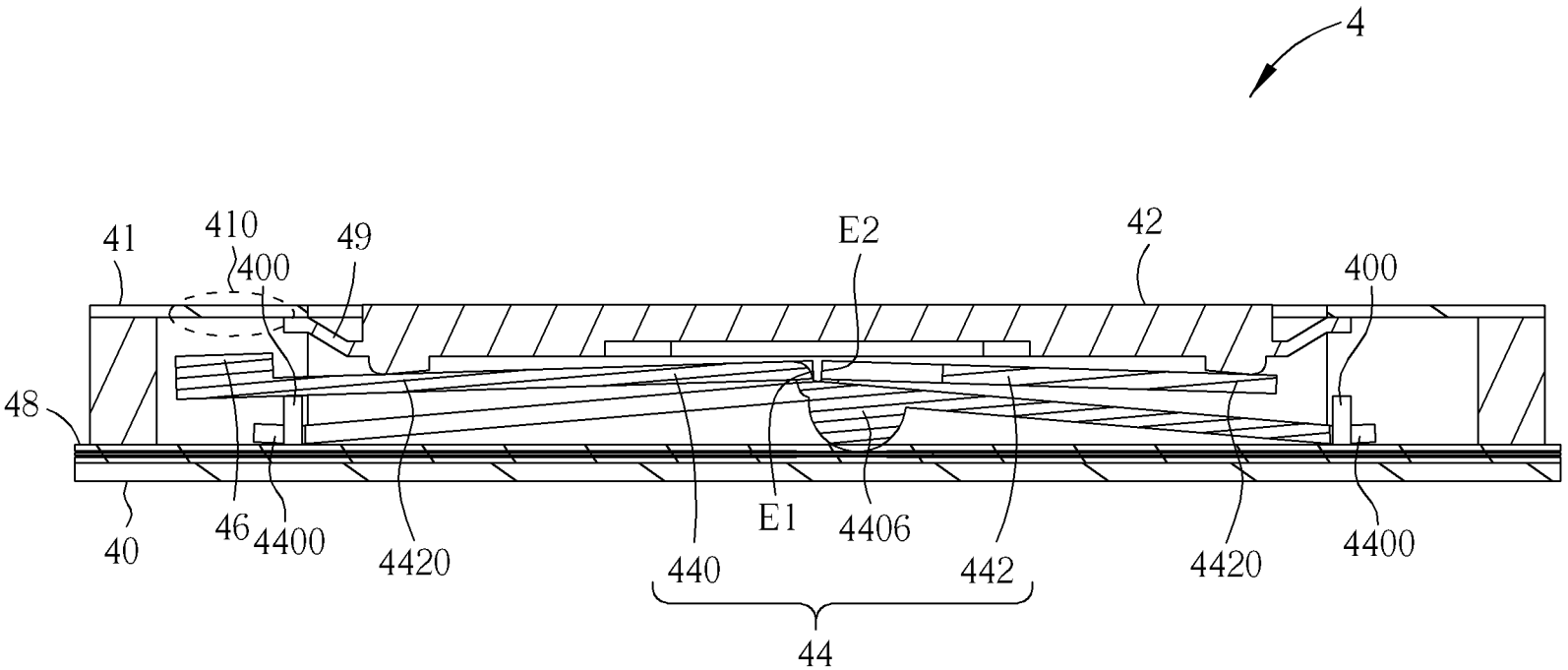
FIG. 13 is a cross-sectional view illustrating the key cap shown in FIG. 12 being pressed.

Referring to FIGS. 10 to 13, FIG. 10 is a perspective view illustrating a keyswitch 4 according to another embodiment of the invention, FIG. 11 is an exploded view illustrating the keyswitch 4 shown in FIG. 10, FIG. 12 is a cross-sectional view illustrating the keyswitch 4 along line C-C shown in FIG. 12, and FIG. 13 is a cross-sectional view illustrating the key cap 42 shown in FIG. 12 being pressed. As shown in FIGS. 10 to 13, the keyswitch 4 comprises a base 40, a frame 41, a key cap 42, a support device 44 and a circuit board 48. In this embodiment, the combination of the base 40 and the frame 41 is a casing of the keyswitch 4. In practical applications, the circuit board 48 may be, but not limited to, a membrane circuit board.

The frame 41 is disposed on the base 40 and the key cap 42 is disposed in the frame 41. In this embodiment, the key cap 42 may be connected to the frame 41 by a flexible material 49. The support device 44 is disposed between the base 40 and the key cap 42 and rotatably connected to the key cap 42 and the base 40. In this embodiment, the support device 44 may comprise a first support member 440 and a second support member 442. Each of the first support member 440 and the second support member 442 comprises a first connecting portion 4400 and a second connecting portion 4420, wherein the first connecting portion 4400 is rotatably connected to the base 40 and the second connecting portion 4420 is rotatably connected to the key cap 42. In this embodiment, the first connecting portion 4400 is rotatably connected to a connecting socket 400 of the base 40 and the second connecting portion 4420 abuts against the key cap 42 so as to be rotatably connected to the key cap 42, but the invention is not limited to this embodiment. Accordingly, the key cap 42 can move with the support device 44 between a non-pressed position (as shown in FIG. 12) and a pressed position (as shown in FIG. 13). Furthermore, the first support member 440 has a first linking portion 4404 and the second support member 442 has a second linking portion 4424. The first linking portion 4404 abuts against the second member 442 and the second linking portion 4424 abuts against the first support member 440 such that the first support member 440 and the second support member 442 can rotate simultaneously when the key cap 42 is pressed or the external force is removed. In this embodiment, the first linking portion 4404 is a plate-shaped structure and the second linking portion 4424 is a U-shaped recess, wherein the plate-shaped structure is disposed in the U-shaped recess such that a first edge E1 of the plate-shaped structure abuts against a second edge E2 of the U-shaped recess The frame 41 has a first magnetic area 410 and the first support member 440 of the support device 44 has a second magnetic area 46 corresponding to the first magnetic area 410. One of the first magnetic area 410 and the second magnetic area 46 may be a magnetic object (e.g. magnet) and the other one of the first magnetic area 410 and the second magnetic area 46 may be a magnetic object (e.g. magnet) or a magnetic induction material (e.g. iron or other metals). In this embodiment, the second magnetic area 46 may be a magnetic object and the first magnetic area 410 may be a magnetic induction material. In practical applications, the support device 44 may be made of magnetic induction material wholly. Furthermore, in another embodiment, the first magnetic area 410 and the second magnetic area 46 both may be magnets.

When the key cap 42 is not pressed, a magnetic attraction force between the first magnetic area 410 and the second magnetic area 46 keeps the key cap 42 at the non-pressed position (as shown in FIG. 12). When a position of the key cap 42, which is corresponding to the first support member 440, is pressed by an external force, which can overcome the magnetic attraction force, the second magnetic area 46 moves away from the first magnetic area 410, the key cap 42 moves with the support device 44 from the non-pressed position toward the pressed position (as shown in FIG. 13). When a position of the key cap 42, which is corresponding to the second support member 442, is pressed by an external force, which can overcome the magnetic attraction force, the second edge E2 presses down the first edge E1 such that the second support member 442 drives the first support member 440 to move and then the second magnetic area 46 moves away from the first magnetic area 410. Accordingly, the key cap 42 moves with the support device 44 from the non-pressed position toward the pressed position (as shown in FIG. 13). When the external force is removed, the second magnetic area 46 moves toward the first magnetic area 410 due to the magnetic attraction force such that the key cap 42 moves with the support device 44 from the pressed position toward the non-pressed position. As shown in FIG. 13, when the key cap 42 is pressed to the pressed position, a triggering portion 4406 of the first support member 440 will trigger switch of the circuit board 48 so as to execute input function correspondingly.

Figure 14:
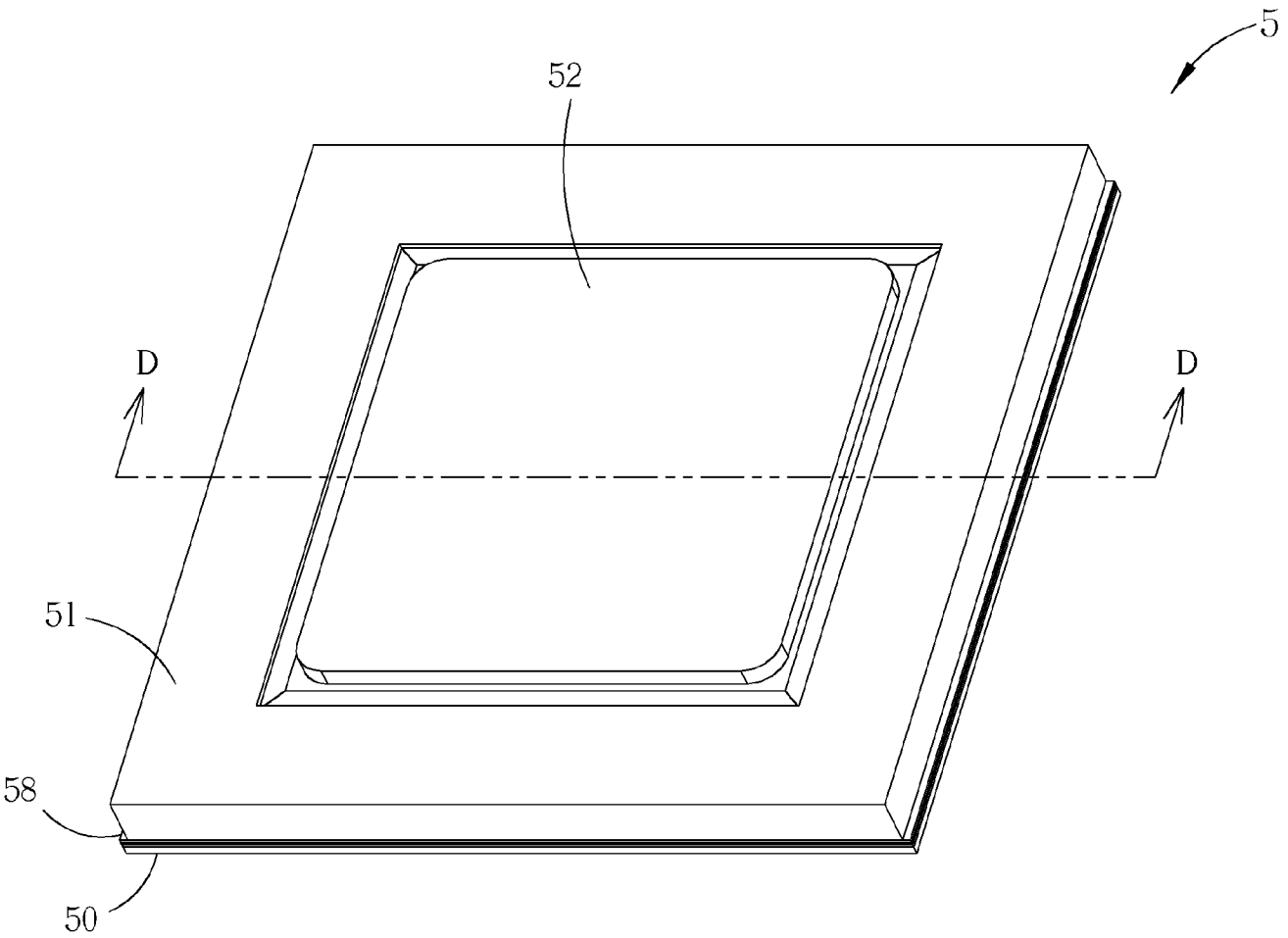
FIG. 14 is a perspective view illustrating a keyswitch according to another embodiment of the invention.
Figure 15:
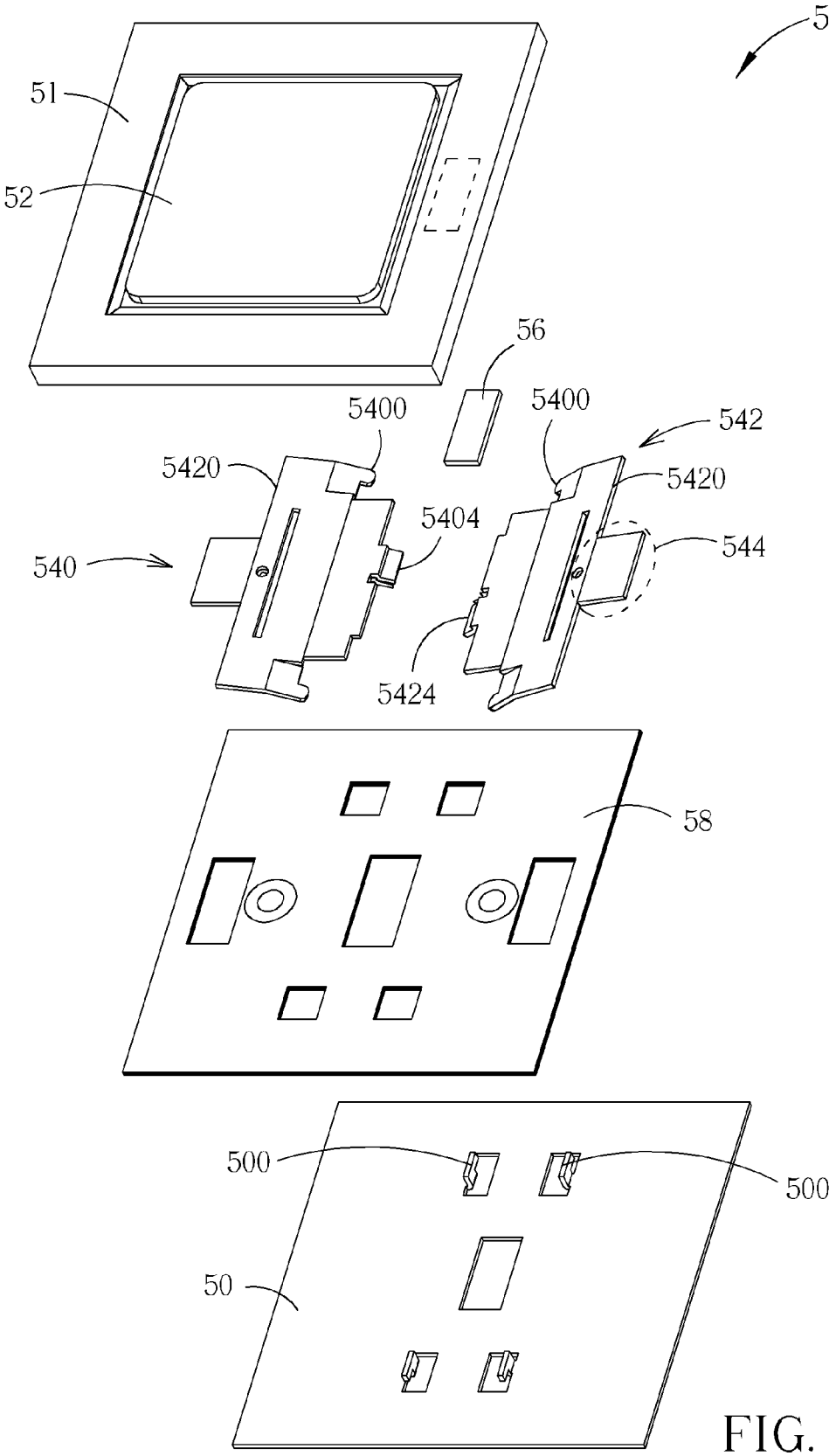
FIG. 15 is an exploded view illustrating the keyswitch shown in FIG. 14.
Figure 16:
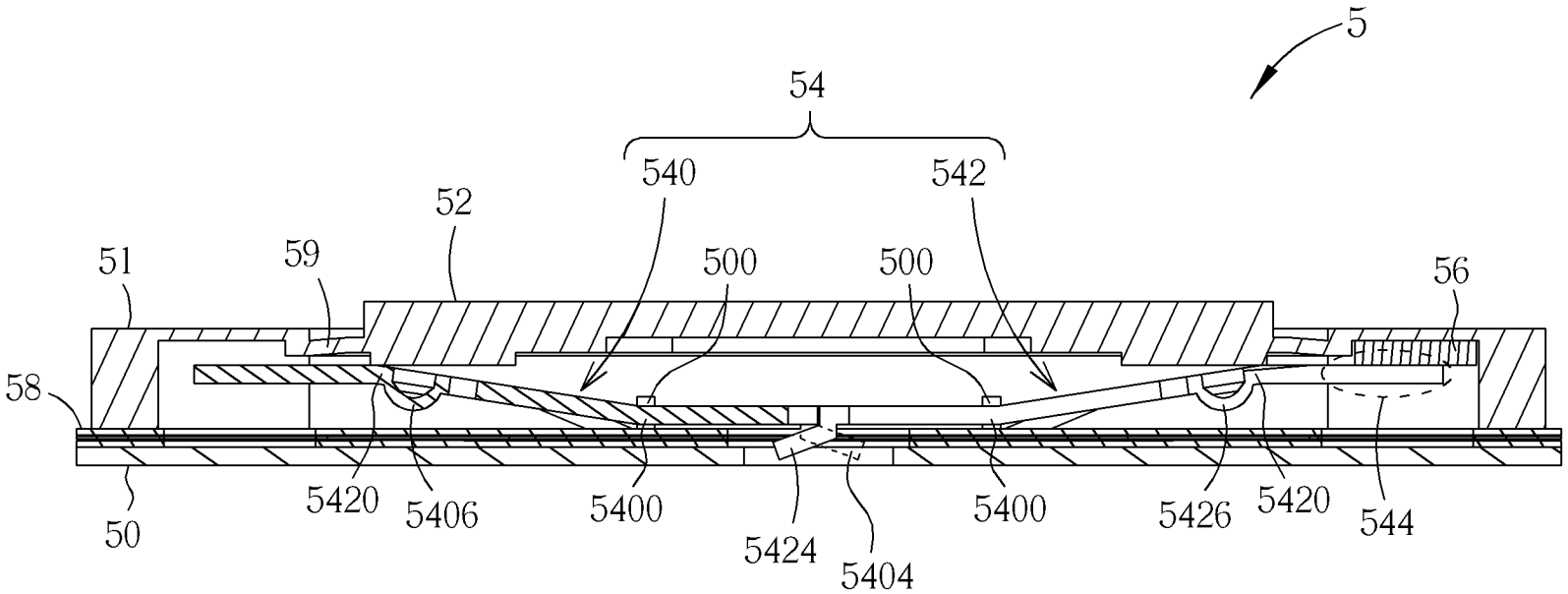
FIG. 16 is a cross-sectional view illustrating the keyswitch along line D-D shown in FIG. 14.
Figure 17:
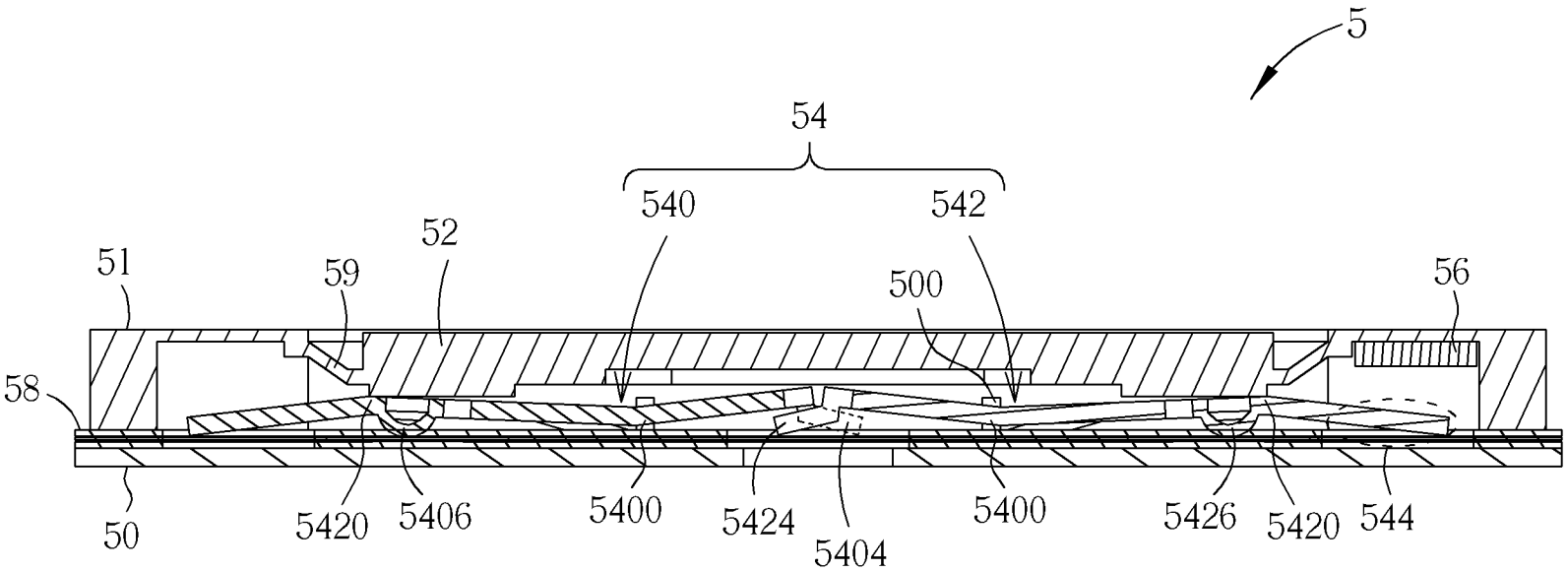
FIG. 17 is a cross-sectional view illustrating the key cap shown in FIG. 16 being pressed.

Referring to FIGS. 14 to 17, FIG. 14 is a perspective view illustrating a keyswitch 5 according to another embodiment of the invention, FIG. 15 is an exploded view illustrating the keyswitch 5 shown in FIG. 14, FIG. 16 is a cross-sectional view illustrating the keyswitch 5 along line D-D shown in FIG. 14, and FIG. 17 is a cross-sectional view illustrating the key cap 52 shown in FIG. 16 being pressed. As shown in FIGS. 14 to 17, the keyswitch 5 comprises a base 50, a frame 51, a key cap 52, a support device 54 and a circuit board 58. In this embodiment, the combination of the base 50 and the frame 51 is a casing of the keyswitch 5. In practical applications, the circuit board 58 may be, but not limited to, a membrane circuit board.

The frame 51 is disposed on the base 50 and the key cap 52 is disposed in the frame 51. In this embodiment, the key cap 52 may be connected to the frame 51 by a flexible material 59. The support device 54 is disposed between the base 50 and the key cap 52 and rotatably connected to the key cap 52 and the base 50. In this embodiment, the support device 54 may comprise a first support member 540 and a second support member 542. Each of the first support member 540 and the second support member 542 comprises a first connecting portion (i.e. a first end portion) 5400 and a second connecting portion (i.e. a central portion) 5420, wherein the first connecting portion 5400 is rotatably connected to the base 50 and the second connecting portion 5420 is rotatably connected to the key cap 52. In this embodiment, the first connecting portion 5400 is rotatably connected to a connecting socket 500 of the base 50 and the second connecting portion 5420 abuts against the key cap 52 so as to be rotatably connected to the key cap 52, but the invention is not limited to this embodiment. In other words, the first connecting portion 5400 is confined in the connecting socket 500 such that the first end portion is rotatably connected to the base 50. Accordingly, the key cap 52 can move with the support device 54 between a non-pressed position (as shown in FIG. 16) and a pressed position (as shown in FIG. 17). Furthermore, the first support member 540 has a first linking portion 5404 and the second support member 542 has a second linking portion 5424. The first linking portion 5404 abuts against the second member 542 and the second linking portion 5424 abuts against the first support member 540 such that the first support member 540 and the second support member 542 can rotate simultaneously when the key cap 52 is pressed or the external force is removed.

The frame 51 has a first magnetic area 56 and the support device 54 has a second magnetic area (i.e. a second end portion) 544 corresponding to the first magnetic area 56. One of the first magnetic area 56 and the second magnetic area 544 may be a magnetic object (e.g. magnet) and the other one of the first magnetic area 56 and the second magnetic area 544 may be a magnetic object (e.g. magnet) or a magnetic induction material (e.g. iron or other metals). In this embodiment, the first magnetic area 56 may be a magnetic object and the second magnetic area 544 may be a magnetic induction material. In practical applications, the support device 54 may be made of magnetic induction material wholly. Furthermore, in another embodiment, the first magnetic area 56 and the second magnetic area 544 both may be magnets.

When the key cap 52 is not pressed, a magnetic attraction force between the first magnetic area 56 and the second magnetic area 544 keeps the key cap 52 at the non-pressed position (as shown in FIG. 16). When the key cap 52 is pressed by an external force, which can overcome the magnetic attraction force, such that the second magnetic area 544 moves away from the first magnetic area 56, the second magnetic area 544 pivots on the first connecting portion (i.e. the first end portion) 5400 such that the key cap 52 moves with the support device 54 from the non-pressed position toward the pressed position (as shown in FIG. 17). When the external force is removed, the second magnetic area 544 moves toward the first magnetic area 56 due to the magnetic attraction force and the second magnetic area 544 drives the first support member 540 and the second support member 542 of the support device 54 to pivot on the first connecting portion (i.e. the first end portion) 5400 such that the key cap 52 moves with the support device 54 from the pressed position toward the non-pressed position. As shown in FIG. 17, when the key cap 52 is pressed to the pressed position, a triggering portion 5406 of the first support member 540 and a triggering portion 5426 of the second support member 542 will trigger switches of the circuit board 58 so as to execute input function correspondingly.

As shown in FIG. 16, the first support member 540 is formed as a V-shaped structure, wherein the first support member 540 has a first end portion 5400 and a second end portion 544 and an angle included between the first end portion 5400 and the second end portion 544 is larger than 90 degrees.

Figure 18:
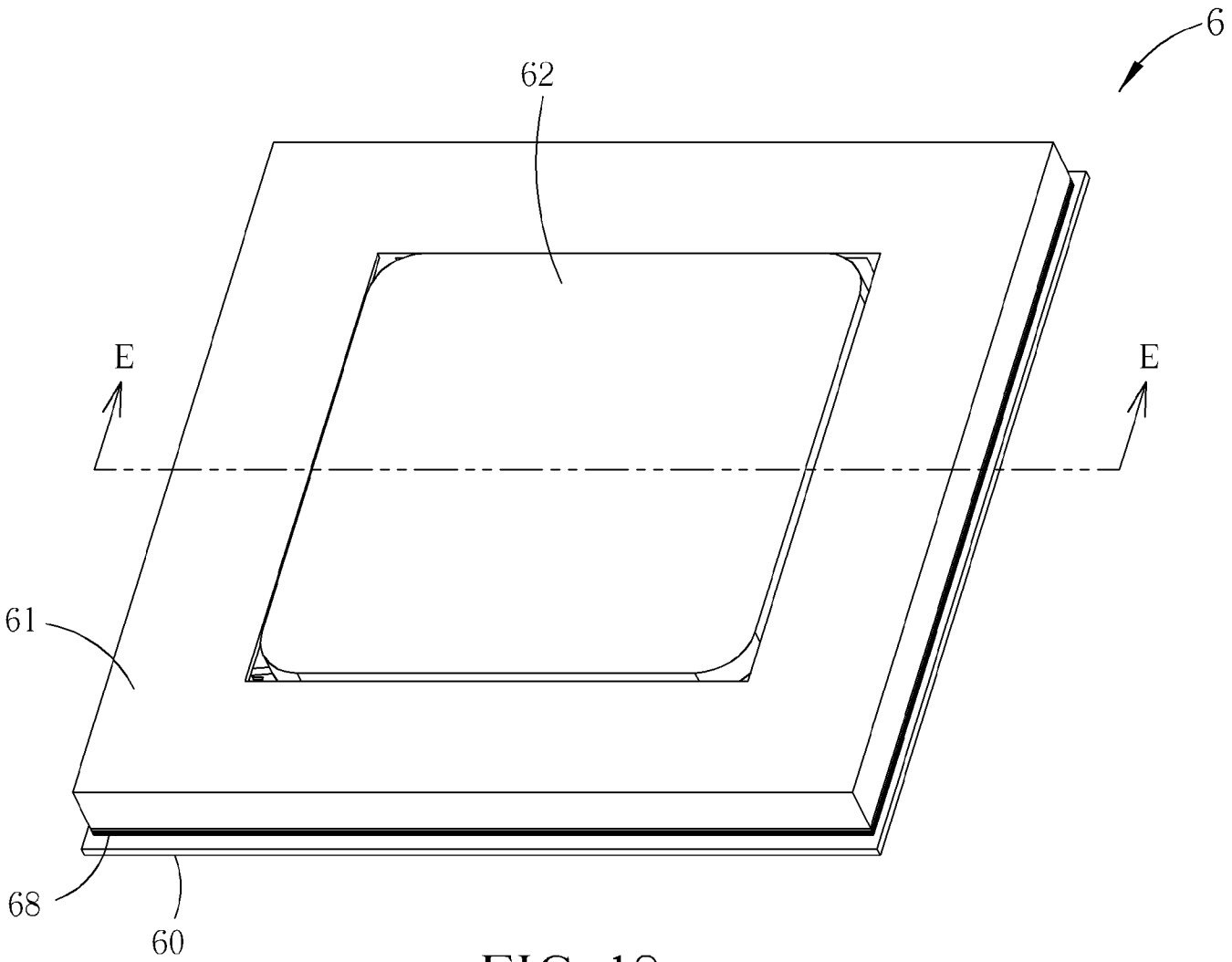
FIG. 18 is a perspective view illustrating a keyswitch according to another embodiment of the invention.
Figure 19:
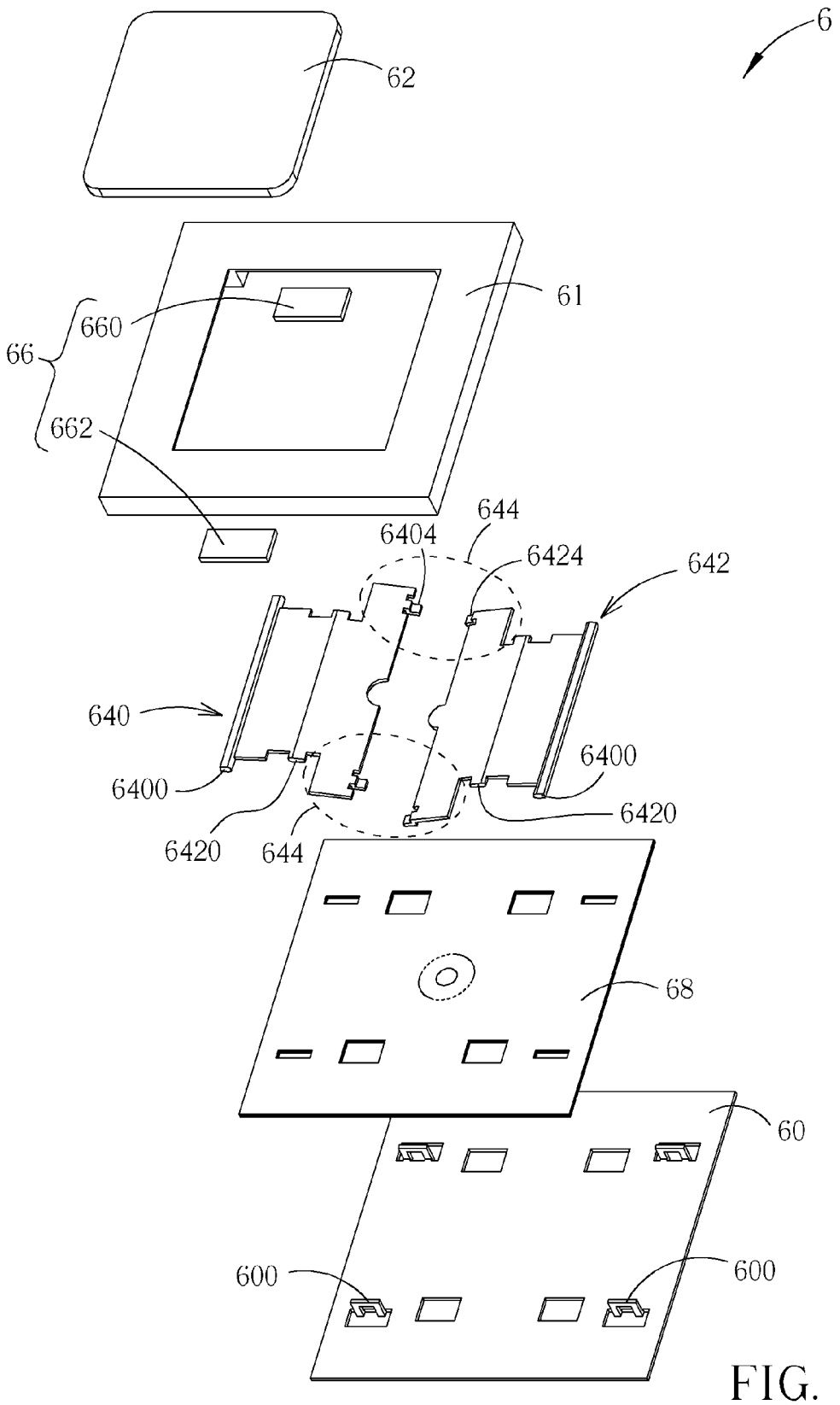
FIG. 19 is an exploded view illustrating the keyswitch shown in FIG. 18.
Figure 20:
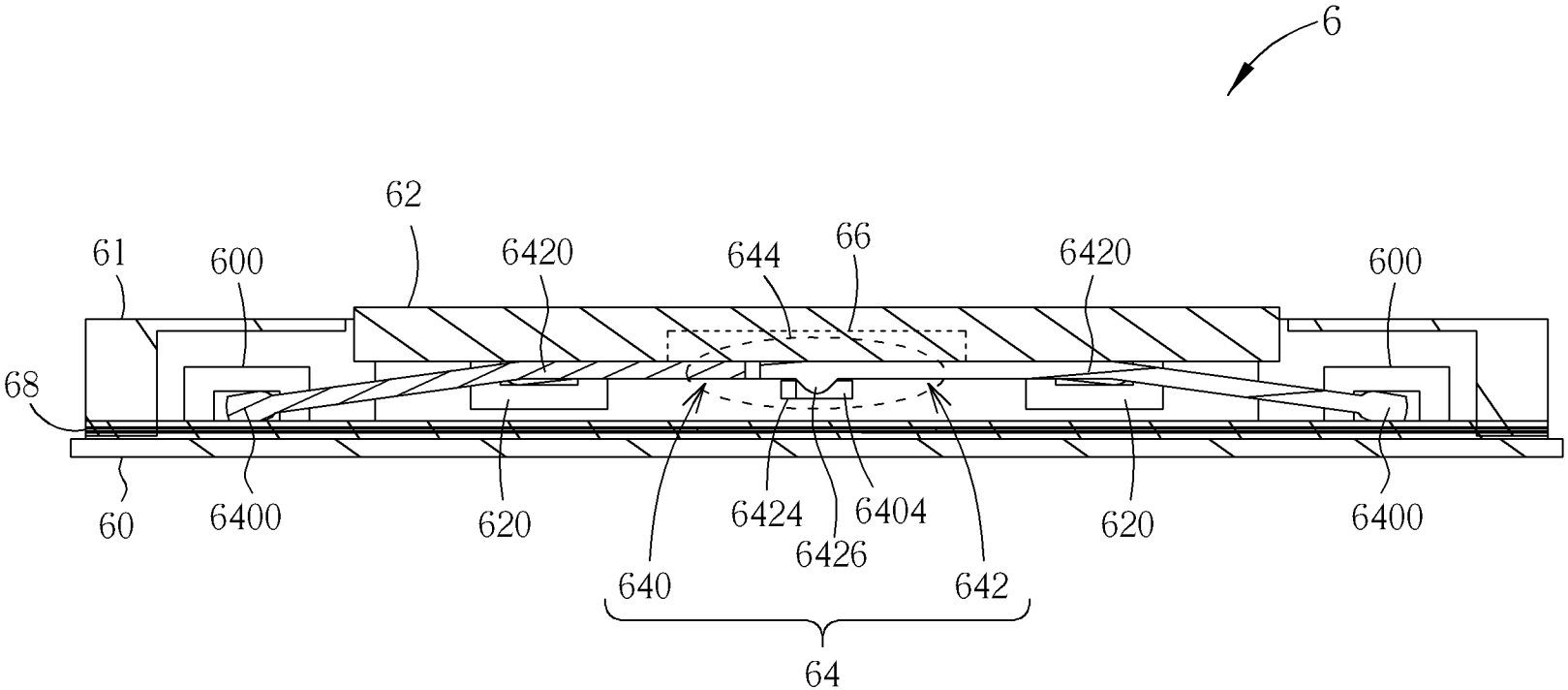
FIG. 20 is a cross-sectional view illustrating the keyswitch along line E-E shown in FIG. 18.
Figure 21:
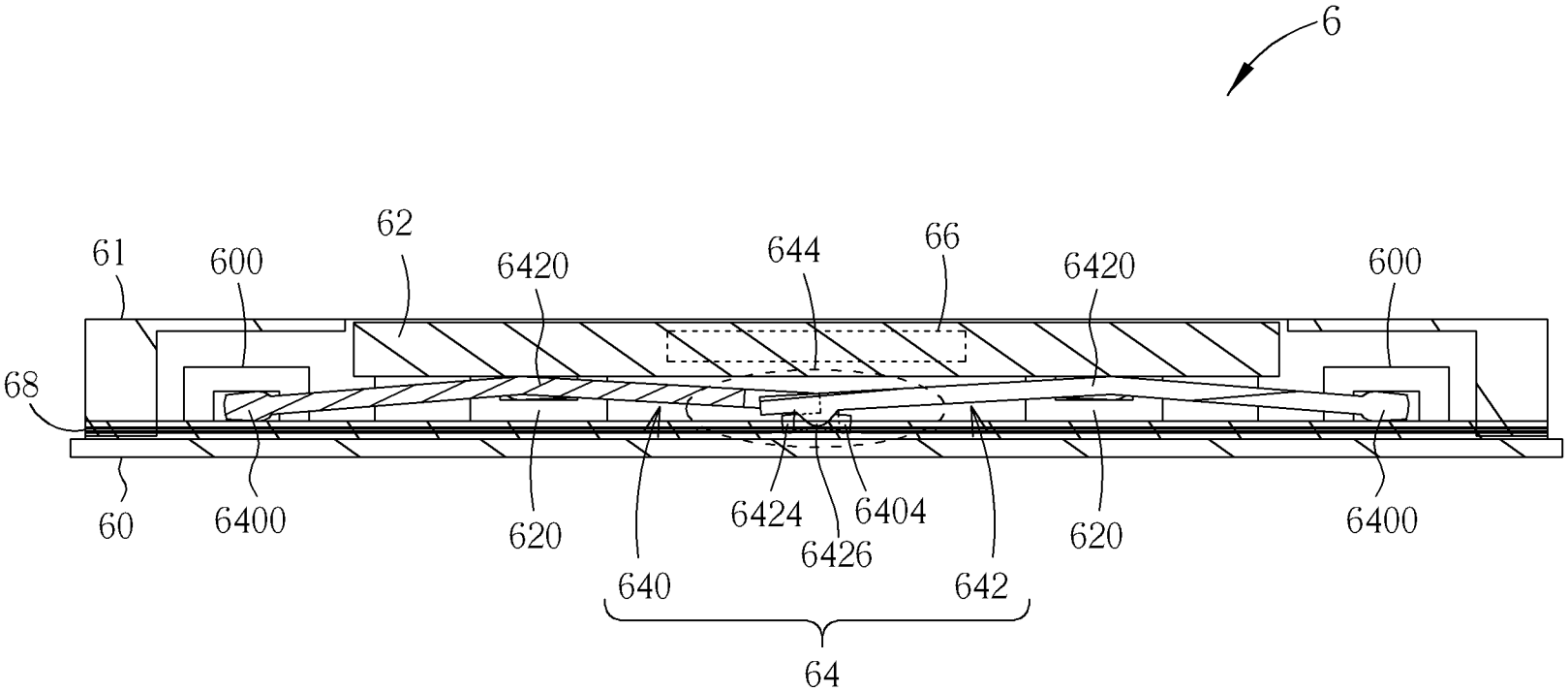
FIG. 21 is a cross-sectional view illustrating the key cap shown in FIG. 20 being pressed.

Referring to FIGS. 18 to 21, FIG. 18 is a perspective view illustrating a keyswitch 6 according to another embodiment of the invention, FIG. 19 is an exploded view illustrating the keyswitch 6 shown in FIG. 18, FIG. 20 is a cross-sectional view illustrating the keyswitch 6 along line E-E shown in FIG. 18, and FIG. 21 is a cross-sectional view illustrating the key cap 62 shown in FIG. 20 being pressed. As shown in FIGS. 18 to 21, the keyswitch 6 comprises a base 60, a frame 61, a key cap 62, a support device 64 and a circuit board 68. In this embodiment, the combination of the base 60 and the frame 61 is a casing of the keyswitch 6. In practical applications, the circuit board 68 may be, but not limited to, a membrane circuit board.

The frame 61 is disposed on the base 60 and the key cap 62 is disposed in the frame 61. The support device 64 is disposed between the base 60 and the key cap 62 and rotatably connected to the key cap 62 and the base 60. In this embodiment, the support device 64 may comprise a first support member 640 and a second support member 642. Each of the first support member 640 and the second support member 642 comprises a first connecting portion (i.e. a first end portion) 6400 and a second connecting portion (i.e. a central portion) 6420, wherein the first connecting portion 6400 is rotatably connected to the base 60 and the second connecting portion 6420 is rotatably connected to the keycap 62. In this embodiment, the first connecting portion 6400 is rotatably connected to a connecting socket 600 of the base 60 and the second connecting portion 6420 is rotatably connected to a connecting socket 620 of the key cap 62, but the invention is not limited to this embodiment. In other words, the first connecting portion 6400 is confined in the connecting socket 600 such that the first end portion is rotatably connected to the base 60. Accordingly, the key cap 62 can move with the support device 64 between a non-pressed position (as shown in FIG. 20) and a pressed position (as shown in FIG. 21). Furthermore, the first support member 640 has a first linking portion 6404 and the second support member 642 has a second linking portion 6424. The first linking portion 6404 abuts against the second member 642 and the second linking portion 6424 abuts against the first support member 640 such that the first support member 640 and the second support member 642 can rotate simultaneously when the key cap 62 is pressed or the external force is removed.

The frame 61 has a first magnetic area 66 and the first magnetic area 66 comprises a first magnetic sub-area 660 and a second magnetic sub-area 662 both disposed on opposite sides of the frame 61. The first support member 640 and the second support member 642 of the support device 64 have second magnetic areas (i.e. second end portions) 644 corresponding to the first magnetic sub-area 660 and the second magnetic sub-area 662, respectively. One of the first magnetic area 66 and the second magnetic area 644 may be a magnetic object (e.g. magnet) and the other one of the first magnetic area 66 and the second magnetic area 644 may be a magnetic object (e.g. magnet) or a magnetic induction material (e.g. iron or other metals). In this embodiment, the first magnetic area 66 may be a magnetic object and the second magnetic area 644 may be a magnetic induction material. In practical applications, the support device 64 may be made of magnetic induction material wholly. Furthermore, in another embodiment, the first magnetic area 66 and the second magnetic area 644 both may be magnets.

When the key cap 62 is not pressed, a magnetic attraction force between the first magnetic sub-area 660 and the second magnetic area 644 and a magnetic attraction force between the second magnetic sub-area 662 and the second magnetic area 644 keep the key cap 62 at the non-pressed position (as shown in FIG. 20). When the key cap 62 is pressed by an external force, which can overcome the magnetic attraction forces, such that the second magnetic area 644 moves away from the first magnetic area 66, the second magnetic area 644 pivots on the second connecting portion (i.e. the central portion) 6420 such that the key cap 62 moves with the support device 64 from the non-pressed position toward the pressed position (as shown in FIG. 21). When the external force is removed, the second magnetic area 644 moves toward the first magnetic area 66 due to the magnetic attraction forces and the second magnetic area 644 drives the first support member 640 and the second support member 642 of the support device 64 to pivot on the second connecting portion (i.e. the central portion) 6420 such that the key cap 62 moves with the support device 64 from the pressed position toward the non-pressed position. As shown in FIG. 21, when the key cap 62 is pressed to the pressed position, a triggering portion 6426 of the second support member 642 will trigger switch of the circuit board 68 so as to execute input function correspondingly.

As shown in FIG. 20, the first support member 640 is formed as a V-shaped structure, wherein the first support member 640 has a first end portion 6400 and a second end portion 644 and an angle included between the first end portion 6400 and the second end portion 644 is larger than 90 degrees.

As mentioned in the above, the first magnetic area of the invention is selectively disposed on one of the casing, which may be the base or a combination of the base and the frame, and the key cap, and the support device has the second magnetic area corresponding to the first magnetic area. When the key cap is not pressed, the magnetic attraction force between the first magnetic area and the second magnetic area keeps the key cap at the non-pressed position. When the key cap is pressed by the external force such that the second magnetic area moves away from the first magnetic area, the key cap moves with the support device from the non-pressed position toward the pressed position. When the external force is removed, the second magnetic area moves toward the first magnetic area due to the magnetic attraction force such that the key cap moves with the support device from the pressed position toward the non-pressed position. Since the resilient member of the conventional keyswitch is unnecessary for the invention, the lifetime of the keyswitch of the invention can be extended effectively.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch comprising:

a casing;

a key cap; and a support device disposed between the casing and the key cap and rotatably connected to the key cap and the casing respectively, the key cap moving with the support device between a non-pressed position and a pressed position;

wherein one of the casing and the key cap has a first magnetic area and the support device has a second magnetic area corresponding to the first magnetic area; when the key cap is not pressed, a magnetic attraction force between the first magnetic area and the second magnetic area keeps the key cap at the non-pressed position; when the key cap is pressed by an external force such that the second magnetic area moves away from the first magnetic area, the key cap moves with the support device from the non-pressed position toward the pressed position; when the external force is removed, the second magnetic area moves toward the first magnetic area due to the magnetic attraction force such that the key cap moves with the support device from the pressed position toward the non-pressed position;

wherein the support device comprises a first support member and a second support member, the first support member has a first linking portion, the second support member has a second linking portion, the first linking portion abuts against the second support member, and the second linking portion abuts against the first support member such that the first support member and the second support member rotates simultaneously when the key cap is pressed or the external force is removed.

2. The keyswitch of claim 1, wherein one of the first magnetic area and the second magnetic area is a magnetic object and the other one of the first magnetic area and the second magnetic area is a magnetic object or a magnetic induction material.

3. The keyswitch of claim 1, wherein the casing comprises a base, the base has the first magnetic area, the support device comprises a first connecting portion and a second connecting portion, the first connecting portion is connected to the base, the second connecting portion is connected to the key cap, when the key cap is pressed by the external force, which overcomes the magnetic attraction force, the second magnetic area pivots on the first connecting portion such that the second magnetic area moves away from the first magnetic area and the key cap moves with the support device from the non-pressed position to the pressed position, when the external force is removed, the first magnetic area attracts the second magnetic area magnetically and then the second magnetic area drives the support device to pivot on the first connecting portion such that the second magnetic area moves toward the first magnetic area and the key cap moves with the support device from the pressed position to the non-pressed position.

4. The keyswitch of claim 1, wherein the casing comprises a base, the base has the first magnetic area, the casing further comprises a frame disposed on the base, the key cap is disposed in the frame and is connected to the frame by a flexible material, and the flexible material surrounds the key cap such that there is no gap between the key cap and the frame.

5. The keyswitch of claim 1, wherein one of the first support member and the second support member has the second magnetic area, one of the key cap and the casing has the first magnetic area, and the magnetic attraction force between the first magnetic area and the second magnetic area keeps the key cap at the non-pressed position; when the key cap is pressed by the external force, a distance between the first magnetic area and the second magnetic area increases and the magnetic attraction force decreases so that the key cap moves with the support device toward the pressed position; when the external force is removed, the distance between the first magnetic area and the second magnetic area decreases due to the magnetic attraction force such that the key cap moves with the support device toward the non-pressed position.

6. A keyswitch comprising:

a base having a first magnetic area;

a key cap; and a support device disposed between the base and the key cap and rotatably connected to the key cap and the base respectively, the key cap moving with the support device between a non-pressed position and a pressed position, the support device having a second magnetic area corresponding to the first magnetic area;

wherein when the key cap is not pressed, a magnetic attraction force between the first magnetic area and the second magnetic area keeps the key cap at the non-pressed position; when the key cap is pressed by an external force such that the second magnetic area moves away from the first magnetic area, the key cap moves with the support device from the non-pressed position toward the pressed position; when the external force is removed, the second magnetic area moves toward the first magnetic area due to the magnetic attraction force such that the key cap moves with the support device from the pressed position toward the non-pressed position;

wherein the support device comprises a first support member and a second support member, the first support member has a first linking portion, the second support member has a second linking portion, the first linking portion abuts against the second support member, and the second linking portion abuts against the first support member such that the first support member makes the second support member rotate simultaneously when the first support member rotates.

7. The keyswitch of claim 6, further comprising a frame disposed on the base, the key cap being disposed in the frame and connected to the frame by a flexible material, the flexible material surrounding the key cap such that there is no gap between the key cap and the frame.

8. The keyswitch of claim 6, wherein the support device comprises a first connecting portion and a second connecting portion, the first connecting portion is connected to the base, the second connecting portion is connected to the key cap, when the key cap is pressed by the external force, which overcomes the magnetic attraction force, the second magnetic area pivots on the first connecting portion such that the second magnetic area moves away from the first magnetic area and the key cap moves with the support device from the non-pressed position toward the pressed position; when the external force is removed, the first magnetic area attracts the second magnetic area magnetically and then the second magnetic area drives the support device to pivot on the first connecting portion such that the second magnetic area moves toward the first magnetic area and the key cap moves with the support device from the pressed position toward the non-pressed position.

9. The keyswitch of claim 8, wherein the base has a connecting socket, the first connecting portion is confined in the connecting socket such that the first connecting portion is rotatably connected to the base.

10. The keyswitch of claim 6, wherein one of the first support member and the second support member has the second magnetic area, the base has the first magnetic area, and the magnetic attraction force between the first magnetic area and the second magnetic area keeps the key cap at the non-pressed position; when the key cap is pressed by the external force, which overcomes the magnetic attraction force, a distance between the first magnetic area and the second magnetic area increases and the magnetic attraction force decreases so that the key cap moves with the support device toward the pressed position; when the external force is removed, the distance between the first magnetic area and the second magnetic area decreases due to the magnetic attraction force such that the key cap moves with the support device toward the non-pressed position.

11. The keyswitch of claim 6, wherein the first support member is formed as a V-shaped structure, the V-shaped structure has a first end portion, a second end portion and a central portion, the first end portion is rotatably connected to the key cap, the central portion is rotatably connected to the base, the second magnetic area is disposed on the second end portion, when the key cap is pressed by the external force, which overcomes the magnetic attraction force, the support device pivots on the central portion such that the second magnetic area moves away from the first magnetic area and the key cap moves with the support device from the non-pressed position toward the pressed position; when the external force is removed, the first magnetic area attracts the second magnetic area magnetically so that the second magnetic area moves toward the first magnetic area and the key cap moves with the support device from the pressed position toward the non-pressed position.

12. The keyswitch of claim 11, wherein an angle included between the first end portion and the second end portion of the V-shaped structure is larger than 90 degrees.

13. The keyswitch of claim 11, wherein the central portion has a first connecting portion, the base has a connecting socket, the first connecting portion is confined in the connecting socket such that the central portion is rotatably connected to the base.

14. A keyswitch for user input comprising:

a base;

a key cap;

a first and second support member each having a first end portion coupled to the key cap, and a second end portion engaging the other support member in an interleaved relation, at least one of the second end portions being formed of or coupled to a second magnetic mass, the first and second support members being rotatably connected to the base; and a first magnetic mass applying a magnetic field to the second magnetic mass to bias the key cap into a non-pressed position;

wherein the first support member comprises a first connecting portion and a second connecting portion, the first connecting portion is connected to the base, the second connecting portion is connected to the key cap, when the key cap is pressed by the external force, the first support member rotates on the first connecting portion such that a distance between the second magnetic mass and the first magnetic mass increases; when the external force is removed, the first magnetic mass attracts the second magnetic mass to drive the first support member to rotate on the first connecting portion such that the distance between the second magnetic mass and the first magnetic mass reduces.

15. The keyswitch of claim 14, wherein the second end portion of the first support member has a first linking portion, the second end portion of the second support member has a second linking portion, the first linking portion abuts against the second support member, and the second linking portion abuts against the first support member to form the interleaved relation between the first and second support members such that the first support member makes the second support member rotate simultaneously when the first support member rotates.

16. The keyswitch of claim 15, wherein one of the first support member and the second support member has the second magnetic mass, the base has the first magnetic mass, and a magnetic attraction force between the first magnetic mass and the second magnetic mass keeps the key cap at the non-pressed position; when the key cap is pressed by an external force, which overcomes the magnetic attraction force, a distance between the first magnetic mass and the second magnetic mass increases; when the external force is removed, the distance between the first magnetic mass and the second magnetic mass decreases due to the magnetic attraction force.

17. The keyswitch of claim 14, wherein the base has a connecting socket, the first connecting portion is confined in the connecting socket such that the first connecting portion is rotatably connected to the base.

18. The keyswitch of claim 14, wherein the first and second support member each is a V-shaped structure, the V-shaped structure has a central portion formed between the first end portion and the second end portion, the first end portion is rotatably connected to the key cap, and the central portion is rotatably connected to the base.

19. The keyswitch of claim 18, wherein an angle included between the first end portion and the second end portion of the V-shaped structure is larger than 90 degrees.

20. The keyswitch of claim 18, wherein the central portion has the first connecting portion, the base has a connecting socket, the first connecting portion is confined in the connecting socket such that the central portion is rotatably connected to the base.

21. A keyswitch comprising:

a base having a first magnetic area;

a key cap; and a support device disposed between the base and the key cap and rotatably connected to the key cap and the base respectively, the key cap moving with the support device between a non-pressed position and a pressed position, the support device having a second magnetic area corresponding to the first magnetic area;

wherein when the key cap is not pressed, a magnetic attraction force between the first magnetic area and the second magnetic area keeps the key cap at the non-pressed position; when the key cap is pressed by an external force such that the second magnetic area moves away from the first magnetic area, the key cap moves with the support device from the non-pressed position toward the pressed position; when the external force is removed, the second magnetic area moves toward the first magnetic area due to the magnetic attraction force such that the key cap moves with the support device from the pressed position toward the non-pressed position;

wherein the support device comprises a first support member with a V-shaped structure, the V-shaped structure has a first end portion, a second end portion and a central portion, the first end portion is rotatably connected to the key cap, the central portion is rotatably connected to the base, the second magnetic area is disposed on the second end portion, when the key cap is pressed by the external force, which overcomes the magnetic attraction force, the support device pivots on the central portion such that the second magnetic area moves away from the first magnetic area and the key cap moves with the support device from the non-pressed position toward the pressed position; when the external force is removed, the first magnetic area attracts the second magnetic area magnetically so that the second magnetic area moves toward the first magnetic area and the key cap moves with the support device from the pressed position toward the non-pressed position.

22. The keyswitch of claim 21, further comprising a frame disposed on the base, the key cap being disposed in the frame and connected to the frame by a flexible material, the flexible material surrounding the key cap such that there is no gap between the key cap and the frame.

23. The keyswitch of claim 21, wherein the support device comprises a first connecting portion and a second connecting portion, the first connecting portion is connected to the base, the second connecting portion is connected to the key cap, when the key cap is pressed by the external force, which overcomes the magnetic attraction force, the second magnetic area pivots on the first connecting portion such that the second magnetic area moves away from the first magnetic area and the key cap moves with the support device from the non-pressed position toward the pressed position; when the external force is removed, the first magnetic area attracts the second magnetic area magnetically and then the second magnetic area drives the support device to pivot on the first connecting portion such that the second magnetic area moves toward the first magnetic area and the key cap moves with the support device from the pressed position toward the non-pressed position.

24. The keyswitch of claim 23, wherein the base has a connecting socket, the first connecting portion is confined in the connecting socket such that the first connecting portion is rotatably connected to the base.

25. The keyswitch of claim 21, wherein the support device further comprises a second support member, one of the first support member and the second support member has the second magnetic area, the base has the first magnetic area, and the magnetic attraction force between the first magnetic area and the second magnetic area keeps the key cap at the non-pressed position; when the key cap is pressed by the external force, which overcomes the magnetic attraction force, a distance between the first magnetic area and the second magnetic area increases and the magnetic attraction force decreases so that the key cap moves with the support device toward the pressed position; when the external force is removed, the distance between the first magnetic area and the second magnetic area decreases due to the magnetic attraction force such that the key cap moves with the support device toward the non-pressed position.

26. The keyswitch of claim 21, wherein an angle included between the first end portion and the second end portion of the V-shaped structure is larger than 90 degrees.

27. The keyswitch of claim 21, wherein the central portion has a first connecting portion, the base has a connecting socket, the first connecting portion is confined in the connecting socket such that the central portion is rotatably connected to the base.

* * * * *